US009797618B2

(12) United States Patent
Yamashita et al.

(10) Patent No.: US 9,797,618 B2
(45) Date of Patent: Oct. 24, 2017

(54) AIR-CONDITIONING APPARATUS

(71) Applicant: Mitsubishi Electric Corporation, Chiyoda-ku (JP)

(72) Inventors: Koji Yamashita, Chiyoda-ku (JP); Hiroyuki Morimoto, Chiyoda-ku (JP); Yuji Motomura, Chiyoda-ku (JP); Takeshi Hatomura, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 234 days.

(21) Appl. No.: 14/625,209

(22) Filed: Feb. 18, 2015

(65) Prior Publication Data

US 2015/0159897 A1 Jun. 11, 2015

Related U.S. Application Data

(63) Continuation of application No. 13/055,841, filed as application No. PCT/JP2008/069606 on Oct. 29, 2008, now abandoned.

(51) Int. Cl.
*F25B 7/00* (2006.01)
*F25B 13/00* (2006.01)
(Continued)

(52) U.S. Cl.
CPC ..... *F24F 11/008* (2013.01); *F24F 3/06* (2013.01); *F24F 11/0012* (2013.01);
(Continued)

(58) Field of Classification Search
CPC .. F24F 3/06; F24F 11/0012; F24F 2011/0013; F24F 2011/0045;
(Continued)

(56) References Cited

U.S. PATENT DOCUMENTS 5,156,014 A 10/1992 Nakamura et al.
5,694,779 A * 12/1997 Matsushima ..... F25B 25/005 62/114
(Continued)

FOREIGN PATENT DOCUMENTS

CN 1177088 A 3/1998
CN 1475705 A 2/2004
(Continued)

OTHER PUBLICATIONS

International Search Report (PCT/ISA/210) dated Jan. 20, 2009, by Japanese Patent Office as the International Searching Authority for International Application No. PCT/JP2008/069606.
(Continued)

*Primary Examiner* — Frantz Jules
*Assistant Examiner* — Meraj Shaikh
(74) *Attorney, Agent, or Firm* — Buchanan Ingersoll & Rooney PC

(57) ABSTRACT

In an air-conditioning apparatus, a heat source side heat exchanger, intermediate heat exchangers, and use side heat exchangers are formed in separate bodies respectively and adapted to be disposed at separate locations one another. In a heat medium circulation circuit where the intermediate heat exchanger and the use side heat exchanger are connected, temperature sensors are installed. An anti-freezing operation mode is provided in which, when the detection temperatures of the temperature sensors become equal to or lower than a set temperature Ts while a compressor or pumps are stopped, the heat medium is circulated to perform anti-freezing of the heat medium.

6 Claims, 13 Drawing Sheets

(51) Int. Cl.

| | |
|---|---|
| ***F24F 11/00*** | (2006.01) |
| ***F24F 3/06*** | (2006.01) |
| ***F25B 25/00*** | (2006.01) |
| ***F25B 47/00*** | (2006.01) |
| ***F25D 17/02*** | (2006.01) |

(52) U.S. Cl.
CPC ..... *F25B 13/00* (2013.01); *F25B 25/005* (2013.01); *F25B 47/006* (2013.01); *F25D 17/02* (2013.01); *F24F 2011/0013* (2013.01); *F24F 2011/0045* (2013.01); *F24F 2011/0087* (2013.01); *F25B 2313/006* (2013.01); *F25B 2313/0231* (2013.01); *F25B 2313/0232* (2013.01); *F25B 2313/0233* (2013.01); *F25B 2313/0272* (2013.01); *F25B 2313/02741* (2013.01); *F25B 2313/0314* (2013.01)

(58) Field of Classification Search
CPC . F24F 2011/0087; F24F 11/008; F24B 13/00; F24B 25/005; F24B 47/006; F24B 2313/006; F24B 2313/0231; F24B 2313/0232; F24B 2313/0233; F24B 2313/0272; F24B 2313/02741; F24B 2313/03; F25D 17/02
See application file for complete search history.

(56) References Cited

U.S. PATENT DOCUMENTS

2005/0067158 A1* 3/2005 Ito ..... B60H 1/00007 165/204
2006/0191286 A1 8/2006 Park et al.
2011/0154844 A1* 6/2011 Lee ..... F25B 7/00 62/278

FOREIGN PATENT DOCUMENTS

| | | | | |
|---|---|---|---|---|
| CN | 1825008 | A | | 8/2006 |
| JP | 49-063247 | A | | 6/1974 |
| JP | 57-192736 | A | | 11/1982 |
| JP | 11-42356 | A | | 6/1989 |
| JP | 01142356 | A | * | 6/1989 |
| JP | 1-100044 | U | | 7/1989 |
| JP | 3-017475 | A | | 1/1991 |
| JP | 03017475 | A | * | 1/1991 |
| JP | 5-215382 | A | | 8/1993 |
| JP | 05215382 | A | * | 8/1993 |
| JP | 5-280818 | A | | 10/1993 |
| JP | 2001-099474 | A | | 4/2001 |
| JP | 2001099474 | A | * | 4/2001 |
| JP | 2003-156223 | A | | 5/2003 |
| JP | 2003-343936 | A | | 12/2003 |
| JP | 2004-028476 | A | | 1/2004 |

OTHER PUBLICATIONS

Office Action dated Sep. 25, 2012, issued by the Chinese Patent Office in the corresponding Chinese Patent Application No. 200880130502.9 and an English translation thereof. (6 pages).
Extended European Search Report dated Sep. 5, 2014, issued by the European Patent Office in the corresponding European Application No. 08877715.6. (7 pages).

* cited by examiner

AIR-CONDITIONING APPARATUS

TECHNICAL FIELD

The present invention relates to an air-conditioning apparatus such as a multiple air conditioner for buildings.

BACKGROUND ART

In a multiple air conditioner, which is a conventional air-conditioning apparatus, cooling energy or heating energy is delivered indoors by circulating a refrigerant between an outdoor unit, which is a heat source apparatus installed outdoors, and an indoor unit installed indoors. As for the refrigerant, an HFC (hydrofluorocarbon) refrigerant is mainly used and the air-conditioning apparatus using a natural refrigerant such as CO2 is proposed.

In a chiller, which is another conventional air-conditioning apparatus, cooling energy or heating energy is generated in a heat source apparatus disposed outdoors, cooling energy or heating energy is transferred to a heat medium such as water and an anti-freezing liquid at a heat exchanger disposed in an outdoor unit, and cooling operation or heating operation is performed by carrying the heat medium to a fan coil unit, a panel heater and the like, which are of an indoor unit (Refer to Patent Literature 1, for example).

Patent Literature 1: Japanese Unexamined Patent Application Publication No. 2003-343936

SUMMARY OF INVENTION

Technical Problem

In the conventional air-conditioning apparatus, since the refrigerant such as HFC is transferred into the indoor unit and utilized, an environment in the room is deteriorated when the refrigerant leaks indoors disadvantageously. In the case of the chiller, since heat exchange is performed outdoors between the refrigerant and water and the water is transferred to the indoor unit, carrying power of water is extremely large and non-energy saving, disadvantageously. Further, there was a fear that water in the piping may possibly freeze.

The present invention is made to solve the above-mentioned problems and its object is to obtain an air-conditioning apparatus having an excellent energy-saving property and an anti-freezing design of the indoor unit side heat medium without circulating the refrigerant such as HFC in the indoor unit.

Solution to Problem

The air-conditioning apparatus according to the present invention comprises: at least one intermediate heat exchanger that exchanges heat between a refrigerant and a heat medium that is different from the refrigerant; a refrigeration cycle in which a compressor, a heat source side heat exchanger, at least one expansion valve, and a refrigerant side flow path of the intermediate heat exchanger are connected via piping through which the refrigerant flows; and a heat medium circulation circuit in which a heat medium side flow path of the intermediate heat exchanger, a pump, and a use side heat exchanger are connected via piping through which the heat medium flows.

The heat source side heat exchanger, the intermediate heat exchanger, and the use side heat exchanger are formed in separate bodies respectively and adapted to be disposed at separate locations one another.

A temperature sensor is installed in the heat medium circulation circuit and there is provided an anti-freezing operation mode in which when a detection temperature of the temperature sensor becomes equal to or lower than a set temperature while the compressor or the pump is stopped, anti-freezing operation of the heat medium is performed. In the anti-freezing operation mode, the pump of the heat medium circulation circuit corresponding to the temperature sensor that detected a temperature equal to or lower than a set temperature was made to operate and the heat medium is made to circulate using the heat medium circulation circuit, for example.

Advantageous Effects of Invention

The air-conditioning apparatus according to the present invention is safe since the problem of refrigerant leakage into the room like the air-conditioning apparatus such as the multiple air conditioner for buildings doesn't occur because no HFC refrigerant is transferred into the indoor unit. The water circulation path is shorter than the air-conditioning apparatus such as a chiller, enabling carrying power of the heat medium such as water to be reduced to achieve energy saving. Further, an anti-freezing operation mode is provided in which anti-freezing operation of the heat medium is performed, therefore, the air-conditioning apparatus having improved reliability can be obtained.

REFERENCE SIGNS LIST

Figure 1:
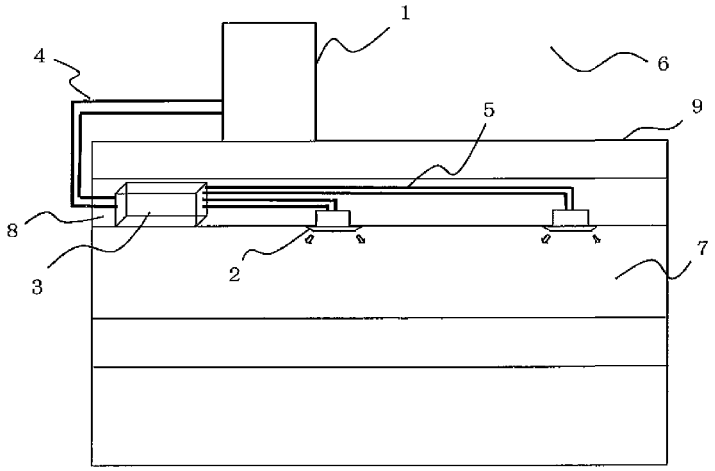
FIG. 1 is an entire configuration diagram of an air-conditioning apparatus according to Embodiment 1 of the present invention.

1 heat source apparatus (outdoor unit)
2 indoor unit
3 relay unit
3*a* main relay unit
3*b*(1), 3*b*(2) sub relay unit
4 refrigerant pipeline
5 heat medium pipeline
6 outdoor space
7 indoor space
8 non-air-conditioning space
9 building
10 compressor
11 four-way valve
12 heat source side heat exchanger
13*a*, 13*b*, 13*c*, 13*d* check valve
14 gas-liquid separator
15*a*, 15*b* intermediate heat exchanger
16*a*, 16*b*, 16*c*, 16*d*, 16*e* expansion valve
17 accumulator
21*a*, 21*b* pump
22*a*, 22*b*, 22*c*, 22*d* flow path switching valve
23*a*, 23*b*, 23*c*, 23*d* flow path switching valve
24*a*, 24*b*, 24*c* stop valve
25*a*, 25*b*, 25*c*, 25*d* flow amount adjustment valve
26*a*, 26*b*, 26*c*, 26*d* use side heat exchanger
27*a*, 27*b*, 27*c*, 27*d* bypass
28*a*, 28*b* bypass stop valve
31*a*, 31*b* first temperature sensor
32*a*, 32*b* second temperature sensor
33*a*, 33*b*, 33*c*, 33*d* third temperature sensor
34*a*, 34*b*, 34*c*, 34*d* fourth temperature sensor
35 fifth temperature sensor
36 pressure sensor
37 sixth temperature sensor
38 seventh temperature sensor

DESCRIPTION OF EMBODIMENTS

Detailed descriptions will be given to the embodiment of the present invention.

Embodiment 1

Figure 2:
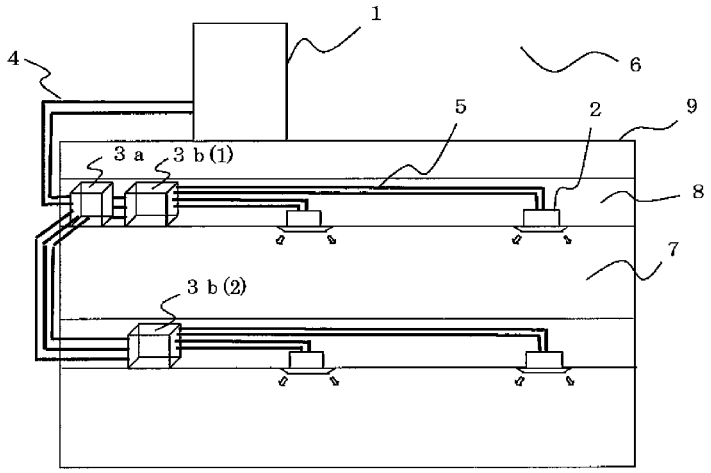
FIG. 2 is another entire configuration diagram of the air-conditioning apparatus according to Embodiment 1 of the present invention.

FIGS. 1 and 2 are an entire configuration diagram of an air-conditioning apparatus according to Embodiment 1 of the present invention. The air-conditioning apparatus includes a heat source apparatus (outdoor unit) 1, an indoor unit 2 subjected to air conditioning of indoors, and a relay unit 3 that is separated from the outdoor unit 1 to be disposed in a non-air-conditioning space 8 or the like. The heat source apparatus 1 and the relay unit 3 are connected by a refrigerant pipeline 4 in which a refrigerant subjected to two-phase transition or a refrigerant (a primary medium) under a supercritical state flows. The relay unit 3 and the indoor unit 2 are connected by a pipeline 5 in which a heat medium (a secondary medium) such as water, brine, or anti-freezing liquid flows. The relay unit 3 exchanges heat between the refrigerant transferred from the heat source apparatus 1 and the heat medium transferred from the indoor unit 2.

The heat source apparatus 1 is usually disposed in an outdoor space 6, which is an external space of structures such as building 9. The indoor unit 2 is disposed at a position capable of carrying heated or cooled air to an indoor space 7 such as a living room inside of structures such as building 9. The relay unit 3 is housed in a different housing from the heat source apparatus 1 and the indoor unit 2, being connected to them by the refrigerant pipeline 4 and the heat medium pipeline 5 of the heat medium, and being adapted to be capable of being disposed at a different location from the outdoor space 6 and the indoor space 7. In FIG. 1, the relay unit 3 is inside the building 9, however, being disposed in a non-air-conditioning space 8 such as under the roof, which is a different space from the indoor space 7. The relay unit 3 can be disposed in a common use space having an elevator or the like.

The heat source apparatus 1 and the relay unit 3 are configured so as to be connected using two refrigerant pipelines 4. The relay unit 3 and each indoor unit 2 are connected using two heat medium pipelines 5 respectively. Connection using two pipelines facilitates the construction of the air-conditioning apparatus.

FIG. 2 shows a case where a plurality of relay units 3 are provided. That is, the relay unit 3 is divided into one main relay unit 3*a* and two sub relay units 3*b*(1) and 3*b*(2) derived therefrom. Accordingly, a plurality of sub relay units 3*b* can be connected with one main relay unit 3*a*. In this configuration, there are three connection pipelines between the main relay unit 3*a* and the sub relay units 3*b*.

In FIGS. 1 and 2, the indoor unit 2 is shown with a ceiling cassette type being an example, however, it is not limited thereto. Any type such as a ceiling-concealed type and a ceiling-suspended type will be allowable as long as heated or cooled air can be blown out into the indoor space 7 directly or through a duct or the like.

The heat source apparatus 1 is explained with the case of being disposed in the outdoor space 6 outside the building 9 as an example, however, it is not limited thereto. For example, the heat source apparatus 1 may be disposed in a surrounded space such as a machine room with a ventilating opening. The heat source apparatus 1 may be disposed inside the building 9 to discharge exhaust heat to outside of the building 9 through an exhaust duct. Alternatively, a water-cooled type heat source apparatus may be employed to be disposed in the building 9.

The relay unit 3 may be disposed near the heat source apparatus 1. However, when the distance from the relay unit 3 to the indoor unit 2 is too long, since the carrying power of the heat medium becomes large, the energy-saving effect is made to be weakened.

Figure 3:
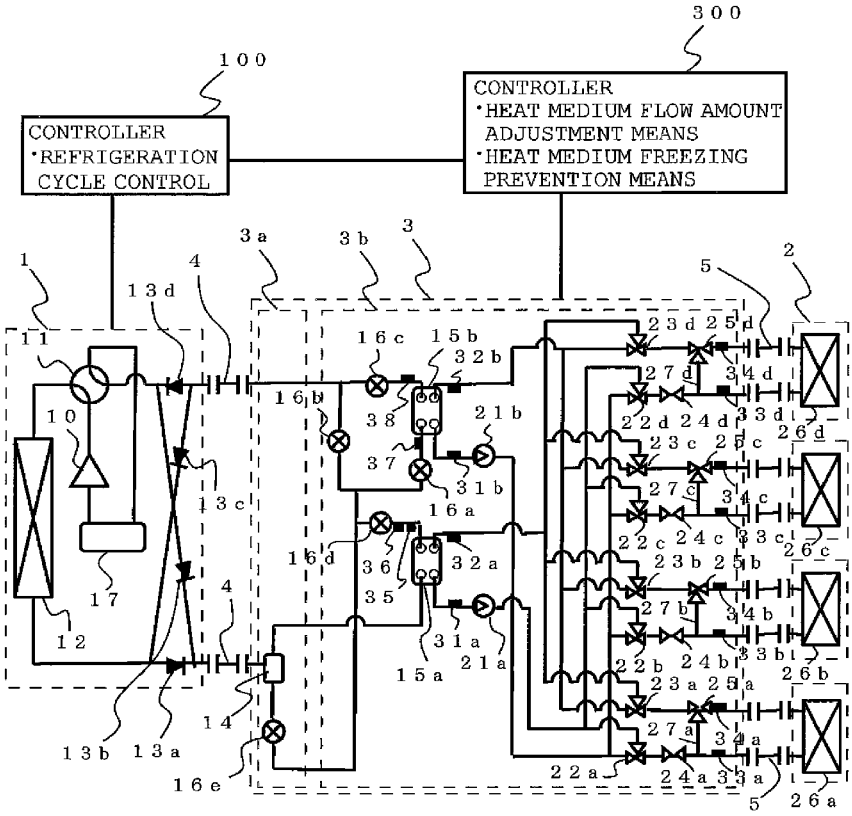
FIG. 3 is a circuit diagram for a refrigerant and a heat medium of the air-conditioning apparatus according to Embodiment 1 of the present invention.

Next, descriptions will be given to detailed configuration of the above air-conditioning apparatus. FIG. 3 is a circuit diagram for the refrigerant and the heat medium of the air-conditioning apparatus according to Embodiment 1 of the present invention. The air-conditioning apparatus, as shown in FIG. 3, has a heat source apparatus 1, an indoor unit 2, and a relay unit 3.

The heat source apparatus 1 includes a compressor 10, a four-way valve 11, a heat source side heat exchanger 12, check valves 13*a*, 13*b*, 13*c* and 13*d*, and an accumulator 17. The indoor unit 2 includes use side heat exchangers 26*a* to 26*d*. The relay unit 3 includes a main relay unit 3*a* and a sub relay unit 3*b*. The main relay unit 3*a* includes a gas-liquid separator 14 to separate a gas phase and a liquid phase of the refrigerant and an expansion valve 16*e* (an electronic expansion valve, for example).

The sub relay unit 3*b* includes intermediate heat exchangers 15*a* and 15*b*, expansion valves (electronic expansion valves, for example) 16*a* to 16*d*, pumps 21*a* and 21*b*, and flow path switching valves 22*a* to 22*d* and 23*a* to 23*d* such as a three-way valve. The flow path switching valves are installed at inlet side flow paths and outlet side flow paths of each use side heat exchanger 26*a* to 26*d*, correspondingly. The flow path switching valves 22*a* to 22*d* switch outlet side flow paths among plurally disposed intermediate heat exchangers. The flow path switching valves 23*a* to 23*d* switch inlet side flow paths thereof. In this example, the flow path switching valves 22*a* to 22*d* perform the operation to switch outlet side flow paths between the intermediate heat exchangers 15*a* and 15*b*, and the flow path switching valves 23*a* to 23*d* perform the operation to switch inlet side flow paths between the intermediate heat exchangers 15*a* and 15*b*.

At inlet sides of the use side heat exchangers 26*a* to 26*d*, stop valves 24*a* to 24*d* are provided, and at outlet sides of the use side heat exchangers 26*a* to 26*d*, flow amount adjustment valves 25*a* to 25*d* are provided, respectively. The inlet side and the outlet side of each use side heat exchanger 26*a* to 26*d* are connected by bypasses 27*a* to 27*d* via the flow amount adjustment valves 25*a* to 25*d*.

The sub relay unit 3*b* further includes temperature sensors and pressure sensors as follows:

- the temperature sensors (first temperature sensors) 31*a* and 31*b* to detect the outlet temperature of the heat medium of the intermediate heat exchangers 15*a* and 15*b;*
- the temperature sensors (second temperature sensors) 32*a* and 32*b* to detect the inlet temperature of the heat medium of the intermediate heat exchangers 15*a* and 15*b;*
- the temperature sensors (third temperature sensors) 33*a* to 33*d* to detect the inlet temperature of the heat medium of the use side heat exchangers 26*a* to 26*d;*
- the temperature sensors (fourth temperature sensors) 34*a* to 34*d* to detect the outlet temperature of the heat medium of the use side heat exchangers 26*a* to 26*d;*
- the temperature sensor (a fifth temperature sensor) 35 to detect the refrigerant outlet temperature of the intermediate heat exchanger 15*a;*
- the pressure sensor 36 to detect the refrigerant outlet pressure of the intermediate heat exchanger 15*a;*
- the temperature sensor (a sixth temperature sensor) 37 to detect the refrigerant inlet temperature of the intermediate heat exchanger 15*b*; and
- the temperature sensor (a seventh temperature sensor) 38 to detect the refrigerant outlet temperature of the intermediate heat exchanger 15*b*.

These temperature sensors and pressure sensors can employ a variety of thermometers, temperature sensors, pressure gauge, and pressure sensors.

The compressor 10, the four-way valve 11, the heat source side heat exchanger 12, the check valves 13*a*, 13*b*, 13*c* and 13*d*, the gas-liquid separator 14, the expansion valves 16*a* to 16*e*, the intermediate heat exchangers 15*a* and 15*b*, and the accumulator 17 configure a refrigeration cycle.

The intermediate heat exchanger 15*a*, the pump 21*a*, the flow path switching valves 22*a* to 22*d*, the stop valves 24*a* to 24*d*, the use side heat exchangers 26*a* to 26*d*, the flow amount adjustment valves 25*a* to 25*d*, and the flow path switching valves 23*a* to 23*d* configure a heat medium circulation circuit. In the same way, the intermediate heat exchanger 15*b*, the pump 21*b*, the flow path switching valves 22*a* to 22*d*, the stop valves 24*a* to 24*d*, the use side heat exchangers 26*a* to 26*d*, the flow amount adjustment valves 25*a* to 25*d*, and the flow path switching valves 23*a* to 23*d* configure a heat medium circulation circuit.

As shown in figures, each of use side heat exchangers 26*a* to 26*d* is provided with the intermediate heat exchangers 15*a* and 15*b* in parallel in plural, each configuring the heat medium circulation circuit.

In the heat source apparatus 1, a controller 100 is provided that controls equipment constituting thereof to make the heat source apparatus 1 perform operations as, what is called, an outdoor unit. In the relay unit 3, a controller 300 is provided that controls equipment constituting thereof and has means to perform operations to be mentioned later. These controllers 100 and 300 are composed of such as microcomputers to be communicably connected with each other. Next, operations of each operation mode of the above air-conditioning apparatus will be explained.

<Cooling Only Operation>

Figure 4:
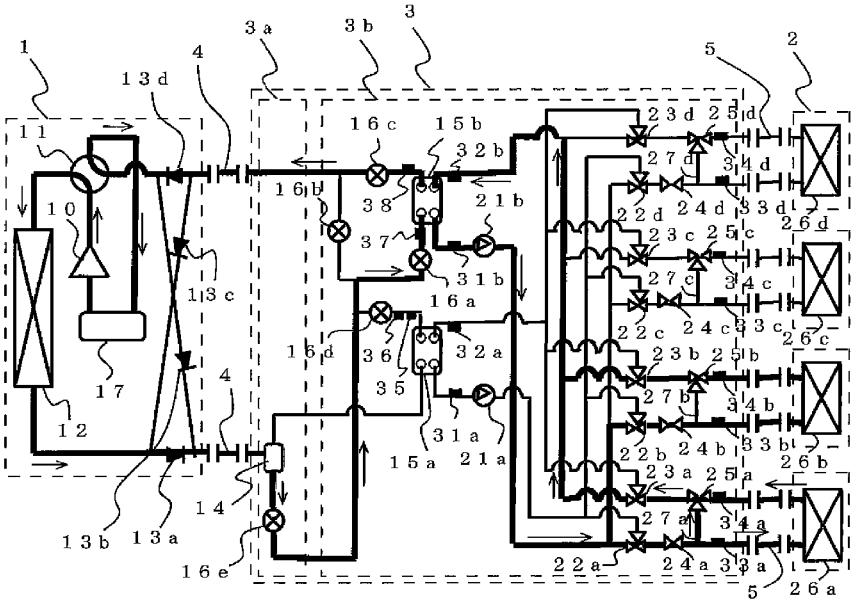
FIG. 4 is a circuit diagram showing the refrigerant and the heat medium flow at the time of cooling only operation.

FIG. 4 is a circuit diagram showing a refrigerant and a heat medium flow at the time of cooling only operation. In the cooling only operation, the refrigerant is compressed by the compressor 10, turned into a high-temperature high-pressure gas refrigerant to enter the heat source side heat exchanger 12 via the four-way valve 11. The refrigerant is condensed and liquefied there, passes through the check valve 13*a*, and flowed out of the heat source apparatus 1 to flow into the relay unit 3 via the refrigerant pipeline 4. In the relay unit 3, the refrigerant enters the gas-liquid separator 14 to be guided into the intermediate heat exchanger 15*b* via the expansion valves 16*e* and 16*a*. Thereby, the refrigerant is expanded by the expansion valve 16*a* to turn into a low-temperature low-pressure two-phase refrigerant and the intermediate heat exchanger 15*b* operates as an evaporator. The refrigerant turns into a low-temperature low-pressure gas refrigerant in the intermediate heat exchanger 15*b* and flows out of the relay unit 3 via the expansion valve 16*c* to flow into the heat source apparatus 1 again via the refrigerant pipeline 4. In the heat source apparatus 1, the refrigerant passes through the check valve 13*d* to be sucked into the compressor 10 via the four-way valve 11 and the accumulator 17. Then, the expansion valves 16*b* and 16*d* have an opening-degree small enough for the refrigerant not to flow and the expansion valve 16*c* is made to be a full-open state so as not to cause a pressure loss.

Next, descriptions will be given to movement of the secondary side heat medium (water, anti-freezing liquid, etc.) In the intermediate heat exchanger 15*b*, cooling energy of the refrigerant on the primary side is transferred to the heat medium on the secondary side, and cooled heat medium is made to flow in the secondary side piping by the pump 21*b*. The heat medium flowed out of the pump 21*b* passes through the stop valves 24*a* to 24*d* via the flow path switching valves 22*a* to 22*d* to flow into the use side heat exchangers 26*a* to 26*d* and the flow amount adjustment valves 25*a* to 25*d*. Then, through the operation of the flow amount adjustment valves 25*a* to 25*d*, only the heat medium having a flow amount necessary to cover the air-conditioning load required indoors is made to flow into the use side heat exchangers 26*a* to 26*d*, and the remaining passes through the bypasses 27*a* to 27*d* to make no contribution to heat exchange. The heat medium passing through the bypasses 27*a* to 27*d* merges with the heat medium passing through the use side heat exchangers 26*a* to 26*d*, passes through the flow path switching valves 23*a* to 23*d*, and flows into the intermediate heat exchanger 15*b* to be sucked again into the pump 21*b*.

The air-conditioning load required indoors can be covered by controlling the flow amount of the heat medium passing through the use side heat exchangers 26*a* to 26*d* so that a difference between the detection temperatures of the third temperature sensors 33*a* to 33*d* and the fourth temperature sensors 34*a* to 34*d* is maintained at a predetermined target value by the controller 300. It will be the same in the case of heating only operation, cooling-main operation, and heating-main operation.

Since there is no need to flow the heat medium to the use side heat exchanger (including thermo-off) having no air-conditioning load, the flow path is closed by the stop valves 24*a* to 24*d* and the heat medium is made not to flow into the use side heat exchanger. In FIG. 4, while in the use side heat exchangers 26*a* and 26*b*, the heat medium is made to flow because of a air-conditioning load, in the use side heat exchangers 26*c* and 26*d*, there is no air-conditioning load and corresponding stop valves 24*c* and 24*d* are closed.

<Heating Only Operation>

Figure 5:
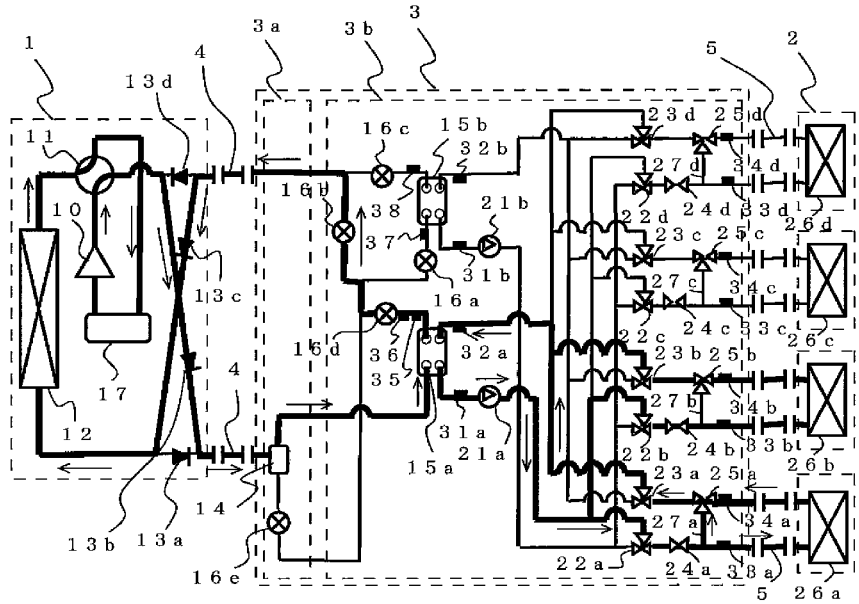
FIG. 5 is a circuit diagram showing the refrigerant and the heat medium flow at the time of heating only operation.

FIG. 5 is a circuit diagram showing a refrigerant and a heat medium flows at the time of heating only operation. In the heating only operation, the refrigerant is compressed by the compressor 10, turns into a high-temperature high-pressure gas refrigerant, passes through the check valve 13*b* via the four-way valve 11, and flows out of the heat source apparatus 1 via the check valve 13*b* to flow into the relay unit 3 via the refrigerant pipeline 4. In the relay unit 3, the refrigerant is guided into the intermediate heat exchanger 15*a* through the gas-liquid separator 14, condensed and liquefied in the intermediate heat exchanger 15*a* to flow out of the relay unit 3 through the expansion valves 16*d* and 16*b*. Thereby, the refrigerant is expanded by the expansion valve 16*b*, turned into a low-temperature low-pressure two-phase refrigerant, and flows into the heat source apparatus 1 again through the refrigerant pipeline 4. In the heat source apparatus 1, the refrigerant is guided into the heat source side heat exchanger 12 through the check valve 13*c* and the heat source side heat exchanger 12 operates as an evaporator. The refrigerant turns into a low-temperature low-pressure gas refrigerant there to be sucked into the compressor 10 via the four-way valve 11 and the accumulator 17. Thereby, the expansion valve 16*e* and the expansion valve 16*a* or 16*c* are made to have a small opening-degree so that no refrigerant flows therethrough.

Next, movement of the secondary side heat medium (water, anti-freezing liquid, etc.) will be explained. In the intermediate heat exchanger 15*a*, heating energy of the primary side refrigerant is transferred to the secondary side heat medium and the heated heat medium is made to flow in the secondary side piping by the pump 21*a*. The heat medium flowed out of the pump 21*a* passes through the stop valves 24*a* to 24*d* via the flow path switching valves 22*a* to 22*d* to flow into the use side heat exchangers 26*a* to 26*d* and the flow amount adjustment valves 25*a* to 25*d*. Then, through the operation of the flow amount adjustment valves 25*a* to 25*d*, only the heat medium having a flow amount necessary to cover the air-conditioning load required indoors is made to flow into the use side heat exchangers 26*a* to 26*d*, and the remaining passes through the bypasses 27*a* to 27*d* to make no contribution to heat exchange. The heat medium passing through the bypasses 27*a* to 27*d* merges with the heat medium passing through the use side heat exchangers 26*a* to 26*d*, passes through the flow path switching valves 23*a* to 23*d*, and flows into the intermediate heat exchanger 15*a* to be sucked again into the pump 21*a*. The air-conditioning load required indoors can be covered by controlling a difference between the detection temperatures of the third temperature sensors 33*a* to 33*d* and the fourth temperature sensors 34*a* to 34*d* to maintain a target value in advance.

Since there is no need to flow the heat medium to the use side heat exchanger (including thermo-off) having no air-conditioning load, the flow path is closed by the stop valves 24*a* to 24*d* and the heat medium is made not to flow into the use side heat exchanger. In FIG. 5, while in the use side heat exchangers 26*a* and 26*b*, the heat medium is made to flow because of a air-conditioning load, in the use side heat exchangers 26*c* and 26*d* there is no air-conditioning load and corresponding stop valves 24*c* and 24*d* are closed.

<Cooling-Main Operation>

Figure 6:
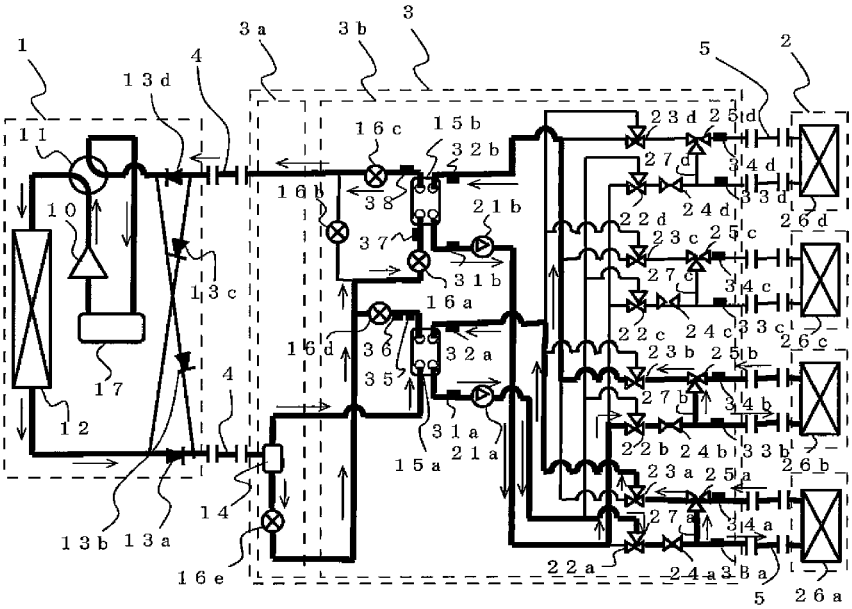
FIG. 6 is a circuit diagram showing the refrigerant and the heat medium flow at the time of cooling-main operation.

FIG. 6 is a circuit diagram showing a refrigerant and a heat medium flow at the time of cooling-main operation. In the cooling-main operation, the refrigerant is compressed by the compressor 10, turned into a high-temperature high-pressure gas refrigerant to be guided into the heat source side heat exchanger 12 via the four-way valve 11. There, the gas-state refrigerant is condensed to turn into a two-phase refrigerant, flows out of the heat source side heat exchanger 12 in the two-phase state, flows out of the heat source apparatus 1 via the check valve 13*a*, and flows into the relay unit 3 via the refrigerant pipeline 4. In the relay unit 3, the refrigerant enters the gas-liquid separator 14 and a gas refrigerant and a liquid refrigerant in the two-phase refrigerant are separated. The gas refrigerant is guided into the intermediate heat exchanger 15*a*, condensed and liquefied therein to pass through the expansion valve 16*d*. Meanwhile, the liquid refrigerant separated in the gas-liquid separator 14 is flowed to the expansion valve 16*e*, joined with the liquid refrigerant condensed and liquefied in the intermediate heat exchanger 15*a* and passing through the expansion valve 16*d*, and guided to the intermediate heat exchanger 15*b* via the expansion valve 16*a*. Then, the refrigerant is expanded by the expansion valve 16*a* to turn into a low-temperature low-pressure two-phase refrigerant and the intermediate heat exchanger 15*b* operates as an evaporator. The refrigerant turns into a low-temperature low-pressure gas refrigerant in the intermediate heat exchanger 15*b* and flows out of the relay unit 3 via the expansion valve 16*c* to flow into the heat source apparatus 1 again via the refrigerant pipeline 4. In the heat source apparatus 1, the refrigerant passes through the check valve 13*d* to be sucked into the compressor 10 via the four-way valve 11 and the accumulator 17. Then, the expansion valves 16*b* has an opening-degree small enough for the refrigerant not to flow and the expansion valve 16*c* is made to be a full open state so as not to cause a pressure loss.

Next, descriptions will be given to movement of the secondary side heat medium (water, anti-freezing liquid, etc.) In the intermediate heat exchanger 15*a*, heating energy of the refrigerant on the primary side is transferred to the heat medium on the secondary side, and heated heat medium is made to flow in the secondary side piping by the pump 21*a*. In the intermediate heat exchanger 15*b*, cooling energy of the refrigerant on the primary side is transferred to the heat medium on the secondary side, and cooled heat medium is made to flow in the secondary side piping by the pump 21*b*. The heat medium flowed out of the pumps 21*a* and 21*b* passes through the stop valves 24*a* to 24*d* via the flow path switching valves 22*a* to 22*d* to flow into the use side heat exchangers 26*a* to 26*d* and the flow amount adjustment valves 25*a* to 25*d*. Then, through the operation of the flow amount adjustment valves 25*a* to 25*d*, only the heat medium having a flow amount necessary to cover the air-conditioning load required indoors is made to flow into the use side heat exchangers 26*a* to 26*d*, and the remaining passes through the bypasses 27*a* to 27*d* to make no contribution to heat exchange. The heat medium passing through the bypasses 27*a* to 27*d* merges with the heat medium passing through the use side heat exchangers 26*a* to 26*d*, and passes through the flow path switching valves 23*a* to 23*d*. The heated heat medium flows into the intermediate heat exchanger 15*a* to return to the pump 21*a* again, and the cooled heat medium flows into the intermediate heat exchanger 15*b* to return to the pump 21*b* again, respectively. Meanwhile, the heated heat medium and the cooled heat medium are guided to the use side heat exchangers 26*a* to 26*d* having the heating load and the cooling load, respectively, without being mixed through the operation of the flow path switching valves 22*a* to 22*d* and 23*a* to 23*d*. The air-conditioning load required indoors can be covered by controlling a difference between the detection temperatures of the third temperature sensors 33*a* to 33*d* and the fourth temperature sensors 34*a* to 34*d* to maintain a target value.

FIG. 6 shows a state in which a heating load is generated in the use side heat exchanger 26*a* and a cooling load is generated in the use side heat exchanger 26*b*, respectively.

Since there is no need to flow the heat medium to the use side heat exchanger (including thermo-off) having no air-conditioning load, the flow path is closed by the stop valves 24*a* to 24*d* and the heat medium is made not to flow into the use side heat exchanger. In FIG. 6, while in the use side heat exchangers 26*a* and 26*b*, the heat medium is made to flow because of a air-conditioning load, in the use side heat exchangers 26*c* and 26*d*, there is no air-conditioning load and corresponding stop valves 24*c* and 24*d* are closed.

<Heating-Main Operation>

Figure 7:
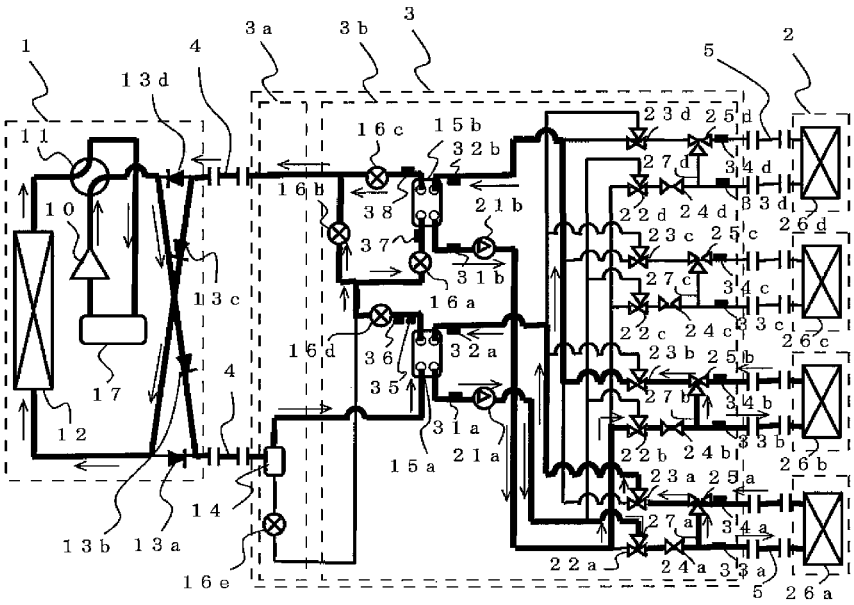
FIG. 7 is a circuit diagram showing the refrigerant and the heat medium flow at the time of heating-main operation.

FIG. 7 is a circuit diagram showing a refrigerant and heat medium flow at the time of heating-main operation. In the heating-main operation, the refrigerant is compressed by the compressor 10, turns into a high-temperature high-pressure gas refrigerant, passes through the check valve 13*b* via the four-way valve 11, and flows out of the heat source apparatus 1 to flow into the relay unit 3 via the refrigerant pipeline 4. In the relay unit 3, the refrigerant is introduced into the intermediate heat exchanger 15*a* through the gas-liquid separator 14, and condensed and liquefied in the intermediate heat exchanger 15*a*. Thereafter, the refrigerant passing through the expansion valve 16*d* is branched into flow paths through the expansion valves 16*a* and 16*b*. The refrigerant passing through the expansion valve 16*a* is expanded by the expansion valve 16*a* to turn into a low-temperature low-pressure two-phase refrigerant and flows into the intermediate heat exchanger 15*b*. The intermediate heat exchanger 15*b* operates as an evaporator. The refrigerant flowed out of the intermediate heat exchanger 15*b* evaporates to turn into a gas refrigerant and passes through the expansion valve 16*c*. On the other hand, the refrigerant passing through the expansion valve 16*b* is expanded by the expansion valve 16*b* to turn into a low-temperature low-pressure two-phase refrigerant, and merges with the refrigerant passing through the intermediate heat exchanger 15*b* and the expansion valve 16*c* to turn into a low-temperature low-pressure refrigerant having larger dryness. Then, the merged refrigerant flows out of the relay unit 3 to flow into the heat source apparatus 1 again through the refrigerant pipeline 4. In the heat source apparatus 1, the refrigerant passes through the check valve 13*c* to be guided into the heat source side heat exchanger 12. The heat source side heat exchanger 12 operates as an evaporator. Then, the low-temperature low-pressure two-phase refrigerant is evaporated into a gas refrigerant and sucked into the compressor 10 via the four-way valve 11 and the accumulator 17. Then, the expansion valve 16*e* is made to have a small opening-degree so that no refrigerant flows.

Next, movement of the secondary side heat medium (water, anti-freezing liquid, etc.) will be explained. In the intermediate heat exchanger 15*a*, heating energy of the primary side refrigerant is transferred to the secondary side heat medium and the heated heat medium is made to flow in the secondary side piping by the pump 21*a*. In the intermediate heat exchanger 15*b*, cooling energy of the primary side refrigerant is transferred to the secondary side heat medium and the cooled heat medium is made to flow in the secondary side piping by the pump 21*b*. Then, the heat medium flowed out of the pumps 21*a* and 21*b* passes through the stop valves 24*a* to 24*d* via the flow path switching valves 22*a* to 22*d* to flow into the use side heat exchangers 26*a* to 26*d* and flow amount adjustment valves 25*a* to 25*d*. Then, through the operation of the flow amount adjustment valves 25*a* to 25*d*, only the heat medium having a flow amount necessary to cover the air-conditioning load required indoors is made to flow into the use side heat exchangers 26*a* to 26*d*, and the remaining passes through the bypasses 27*a* to 27*d* to make no contribution to heat exchange. The heat medium passing through the bypasses 27*a* to 27*d* merges with the heat medium passing through the use side heat exchangers 26*a* to 26*d*, passes through the flow path switching valves 23*a* to 23*d*. The heated heat medium flows into the intermediate heat exchanger 15*a* to return to the pump 21*a* again, and the cooled heat medium flows into the intermediate heat exchanger 15*b* to return to the pump 21*b* again. Meanwhile, the heated heat medium and the cooled heating medium are guided to the use side heat exchangers 26*a* to 26*d* having the heating load and the cooling load, respectively, without being mixed through the operation of the flow path switching valves 22*a* to 22*d* and 23*a* to 23*d*. The air-conditioning load required indoors can be covered by controlling a difference between the detection temperatures of the third temperature sensors 33*a* to 33*d* and the fourth temperature sensors 34*a* to 34*d* to maintain a target value.

FIG. 7 shows a state in which a heating load is generated in the use side heat exchanger 26*a* and a cooling load is generated in the use side heat exchanger 26*b*, respectively.

Since there is no need to flow the heat medium to the use side heat exchanger (including thermo-off) having no air-conditioning load, the flow path is closed by the stop valves 24*a* to 24*d* and the heat medium is made not to flow into the use side heat exchanger. In FIG. 7, while in the use side heat exchangers 26*a* and 26*b*, the heat medium is made to flow because of a air-conditioning load, in the use side heat exchangers 26*c* and 26*d*, there is no air-conditioning load and corresponding stop valves 24*c* and 24*d* are closed.

As mentioned above, heating operation and cooling operation can be freely performed in each indoor unit 2 by switching the corresponding flow path switching valves 22*a* to 22*d* and 23*a* to 23*d* to the flow path connected to the heating intermediate heat exchanger 15*a* when heating load is generated in the use side heat exchangers 26*a* to 26*d*, and by switching the corresponding flow path switching valves 22*a* to 22*d* and 23*a* to 23*d* to the flow path connected to the cooling intermediate heat exchanger 15*b* when cooling load is generated in the use side heat exchangers 26*a* to 26*d*.

The flow path switching valves 22*a* to 22*d* and 23*a* to 23*d* may be any that can switch flow paths such as a combination of a three-way valve to switch three-way flow paths and a stop valve to open/close two-way flow paths. The flow path switching valve may be configured by a combination of a stepping-motor-driven mixing valve to change the flow amount of three-way flow paths and an electronic expansion valve to change the flow amount of two-way flow paths. In that case, water hammer can be prevented by a sudden opening/closing of the flow path.

The air-conditioning load in the use side heat exchangers 26*a* to 26*d* is expressed by formula 1, being obtained by multiplying the flow rate, the density, the constant pressure specific heat of the heat medium and the difference in temperature of the heat medium at the inlet and at the outlet of the use side heat exchangers 26*a* to 26*d*. Here, Vw denotes the flow amount of the heat medium, ρw the density of the heat medium, Cpw the constant pressure specific heat of the heat medium, Tw the temperature of the heat medium, suffix "in" the value at the inlet of the heat medium of the use side heat exchangers 26*a* to 26*d*, suffix "out" the value at the outlet of the heat medium of the use side heat exchangers 26*a* to 26*d*, respectively.

Formula 1

$$Q=V_w*(\rho_{win}*Cp_{win}*T_{win}-\rho_{wout}*Cp_{wout}*T_{wout})\sim V_w*\rho_w*Cp_w*(T_{win}-T_{wout}) \quad (1)$$

When the flow amount of the heat medium flowing to the use side heat exchangers 26*a* to 26*d* is fixed, the temperature difference of the heat medium at the inlet and the outlet changes according to the change of the air-conditioning load in the use side heat exchangers 26*a* to 26*d*. Therefore, the temperature difference at the inlet and outlet of the use side heat exchanger 26*a* to 26*d* is set to be a temporary target and it is possible to flow surplus heat medium to the bypasses 27*a* to 27*d* to control the flow amount that follows to the use side heat exchangers 26*a* to 26*d* by controlling the flow amount adjustment valves 25*a* to 25*d* so that the temporary target approaches a predetermined target value. The target value of the temperature difference at the inlet and outlet of the use side heat exchangers 26*a* to 26*d* may be set at, for example, 5 degrees C.

In FIGS. 3 to 7, descriptions are given to the case where the flow amount adjustment valves 25*a* to 25*d* are a mixing valve installed at the downstream side of the use side heat exchangers 26*a* to 26*d*, however, a three-way valve is allowable installed at the upstream side of the use side heat exchangers 26*a* to 26*d*.

Then, the heat medium that exchanged heat with the use side heat exchangers 26*a* to 26*d* and heat medium that passed through the bypasses 27*a* to 27*d* with no heat exchange and no change in temperature merge at a merged section thereafter. Formula (2) holds in the merged section. Here, Twin and Twout denote the heat medium temperatures at the inlet and the outlet of the use side heat exchangers 26*a* to 26*d*, Vw the flow amount of the heat medium flowing into the flow amount adjustment valves 25*a* to 25*d*, Vwr the flow amount of the heat medium flowing into the use side heat exchangers 26*a* to 26*d*, Tw the temperature of the heat medium after the heat medium flowing through the use side heat exchangers 26*a* to 26*d* and the heat medium flowing through the bypasses 27*a* to 27*d* are merged.

Formula 2

$$T_w=(V_{wr}/V_w)*T_{wout}+(1-V_{wr}/V_w)*T_{win} \quad (2)$$

When the heat medium that exchanged heat in the use side heat exchangers 26*a* to 26*d* to have a change in temperature and the heat medium that passed through the bypasses 27*a* to 27*d* with no heat exchange and no change in temperature merge, the temperature difference between the heat media approaches the inlet temperature of the use side heat exchangers 26*a* to 26*d* by the flow amount that is bypassed. For example, when the total flow amount is 20 L/min, the inlet temperature of the heat medium of the use side heat exchangers 26*a* to 26*d* 7 degrees C., the outlet temperature 13 degrees C., the flow amount flowed toward the use side heat exchangers 26*a* to 26*d* side 10 L/min, the temperature after merging becomes 10 degrees C. by formula (2).

The heat medium having the temperature after the merging returns from each indoor unit to merge and flows into the intermediate heat exchangers 15*a* and 15*b*. Then, unless the heat exchange amount of the intermediate heat exchanger 15*a* or 15*b* changes, the temperature difference between the inlet and outlet becomes almost the same through the heat exchange in the intermediate heat exchanger 15*a* or 15*b*. For example, it is assumed that the temperature difference between the inlet and outlet of the intermediate heat exchanger 15*a* or 15*b* is 6 degrees C., and at first, the inlet temperature of the intermediate heat exchanger 15*a* or 15*b* is 13 degrees C. and the outlet temperature is 7 degrees C. Further, the air-conditioning load in the use side heat exchangers 26*a* to 26*d* is lowered and the inlet temperature of the intermediate heat exchanger 15*a* or 15*b* decreases to 10 degrees C. Then, if nothing be done, since the intermediate heat exchanger 15*a* or 15*b* performs heat exchange of almost the same amount, the heat medium flows out of the intermediate heat exchanger 15*a* or 15*b* at 4 degrees C. The above is repeated and the temperature of the heat medium rapidly decreases.

In order to prevent the above, the rotation speed of the pumps 21*a* and 21*b* may be changed according to changes in the air-conditioning load of the use side heat exchangers 26*a* to 26*d* so that the heat medium outlet temperature of the intermediate heat exchanger 15*a* or 15*b* approaches a target value. Thereby, when the air-conditioning load is lowered, the rotation speed of the pump decreases to achieve energy-saving. When the air-conditioning load increases, the rotation speed of the pump increases to cover the air-conditioning load.

The pump 21*b* operates when cooling load or dehumidifying load occurs in any of the use side heat exchangers 26*a* to 26*d*, and is stopped when there is neither cooling load nor dehumidifying load in each use side heat exchangers 26*a* to 26*d*. The pump 21*a* operates when the heating load occurs in any of the use side heat exchangers 26*a* to 26*d*, and is stopped when there is no heating load in any of use side heat exchangers 26*a* to 26*d*.

Next descriptions will be given to anti-freezing of the heat medium flow path. The heat medium flow path at the secondary side from the intermediate heat exchangers 15*a* and 15*b* to the use side heat exchangers 26*a* to 26*d* is in general disposed inside of the building and is usually maintained at a higher temperature than a freezing temperature of the heat medium, 0 degree C. in the case of water, for example. However, in the case which the compressor 10 and the pump 21*a* or 21*b* are stopped for a long time, or the intermediate heat exchangers 15*a* and 15*b* are disposed outdoors, the heat medium flow path may be cooled to reach the refrigeration temperature. Accordingly, an anti-freezing operation is required that prevents the heat medium from freezing. Descriptions will be given to the heat medium anti-freezing operation (anti-freezing operation mode).

The anti-freezing operation is performed through the operation of heat medium anti-freezing operation means of the controller 300. The controller 300 performs the anti-freezing operation when the detection temperature of any of the first temperature sensors 31*a* and 31*b*, the second temperature sensors 32*a* and 32*b*, the third temperature sensors 33*a* to 33*b*, and the fourth temperature sensors 34*a* to 34*d* becomes equal to or lower than a predetermined set temperature.

When any of the above-mentioned detection temperatures becomes equal to or lower than the set temperature, the temperature of the whole heat medium flow path can be made uniform by making the pump 21*a* or 21*b* to operate to circulate the heat medium and agitating the heat medium in the heat medium piping to rise the temperature of the heat medium at the part where the temperature has decreased and prevent freezing.

It depends on which of the above-mentioned detection temperature detection means has detected equal to or lower than the set temperature to operate either the pump 21*a* or 21*b*. That is, when either the first temperature sensor 31*a* or the second temperature sensor 32*a* detects equal to or lower than the set temperature, the pump 21*a* is made to operate. When either the first temperature sensor 31*b* or the second temperature sensor 32*b* detects equal to or lower than the set temperature, the pump 21*b* is made to operate. Further, when either the third temperature sensors 33*a* to 33*d* or the fourth temperature sensors 34*a* to 34*d* detects equal to or lower than the set temperature, either the pump 21*a* or 21*b* that is connected with the corresponding use side heat exchangers 26*a* to 26*d* is made to operate to circulate the heat medium.

The operation of the above-mentioned anti-freezing operation by the controller 300 will be explained by the flow chart of FIG. 13. In the explanation of each flow chart, the flow path switching valves 22*a* to 22*d* are explained as the flow path switching valve 22, the flow path switching valves 23*a* to 23*d* as the flow path switching valve 23, the stop valves 24*a* to 24*d* as the stop valve 24, the flow amount adjustment valves 25*a* to 25*d* as the flow amount adjustment valve 25, the bypasses 27*a* to 27*d* as the bypass 27, the third temperature sensors 33*a* to 33*d* as the third temperature sensor 33, and the fourth temperature sensors 34*a* to 34*d* as the fourth temperature sensor 34.

After the processing starts (ST0), the controller 300 operates the pump 21*a* (ST5) when the first temperature sensor 31*a* or the second temperature sensor 32*a* detects the temperature equal to or lower than the set temperature Ts (ST1, ST2). The controller 300 operates the pump 21*b* (ST6) when the first temperature sensor 31*b* or the second temperature sensor 32*b* detects the temperature equal to or lower than the set temperature Ts (ST3, ST4). When any of these are detected, the flow path switching valve 22 corresponding to the use side heat exchanger 26*a* of the first indoor unit (1) is switched to the heating intermediate heat exchanger 15*a*, the flow path switching valve 23 to the cooling intermediate heat exchanger 15*b*, for example. Further, the flow path switching valve 22 corresponding to the use side heat exchanger 26*b* of the second indoor unit (2) is switched to the cooling intermediate heat exchanger 15*b*, the flow path switching valve 23 to the heating intermediate heat exchanger 15*a*, for example (ST7). The stop valve 24 of the use side heat exchangers 26*a* and 26*b* is made to be open and the flow amount adjustment valve 25 is made to be full open to the bypass 27 side.

From "1" of the indoor unit to the maximum number of installed units, the detection temperatures of the third temperature sensor 33 and the fourth temperature sensor 34 corresponding to each unit are searched in order (ST9, ST15, ST16). When the third temperature sensor 33 or the fourth temperature sensor 34 detects the temperature equal to or lower than the set temperature Ts (ST10, ST11), the pump 21*a* or 21*b* is made to operate (ST12). Then, the flow path switching valve 22 of the n-th indoor unit (n) that detected the temperature equal to or lower than the set temperature is switched to the heating intermediate heat exchanger 15*a*, and the flow path switching valve 23 to the cooling intermediate heat exchanger 15*b*. The flow path switching valve 22 of the (n+1)-th indoor unit (n+1) is switched to the cooling intermediate heat exchanger 15*b*, and the flow path switching valve 23 to the heating intermediate heat exchanger 15*a* (ST13). The stop valve 24 of the indoor units (n) and (n+1) is made to be open and the flow amount adjustment valve 25 of the indoor unit (n) is made to be full open at the use side heat exchanger 26 side (ST14).

When the detection temperatures of all the above-mentioned temperature sensors become higher than the set temperature Ts (ST17), the pumps 21*a* and 21*b* are made to stop (ST18) to complete processing (ST19). In cases of ST5, ST6, and ST12, both pumps 21*a* and 21*b* may be operated.

The above-mentioned heat medium anti-freezing operation mode is a method of performing anti-freezing by making the heat medium to circulate with use of the pumps 21*a* and 21*b* and agitating the heat medium in the flow path to make the temperature uniform. However, with this method, since no heat medium is heated, the heat medium gets refrigerated eventually when the heat medium flow path continues to be cooled.

Therefore, to further perform anti-freezing with accuracy, when any of the above-mentioned each temperature sensor detect the temperature equal to or lower than the set temperature, in the state of operating the pump 21*a* or 21*b* corresponding with the intermediate heat exchanger 15*a* or 15*b* corresponding to the temperature sensor that detects the temperature equal to or lower than the set temperature, the compressor 10 is made to operate, the four-way valve 11 is switched to the heating side, the high-temperature high-pressure refrigerant is introduced into the intermediate heat exchanger 15*a* or 15*b* corresponding to the temperature sensor that detected the temperature equal to or lower than the set temperature, and anti-freezing is performed by heating the heat medium to rise the temperature.

Figure 8:
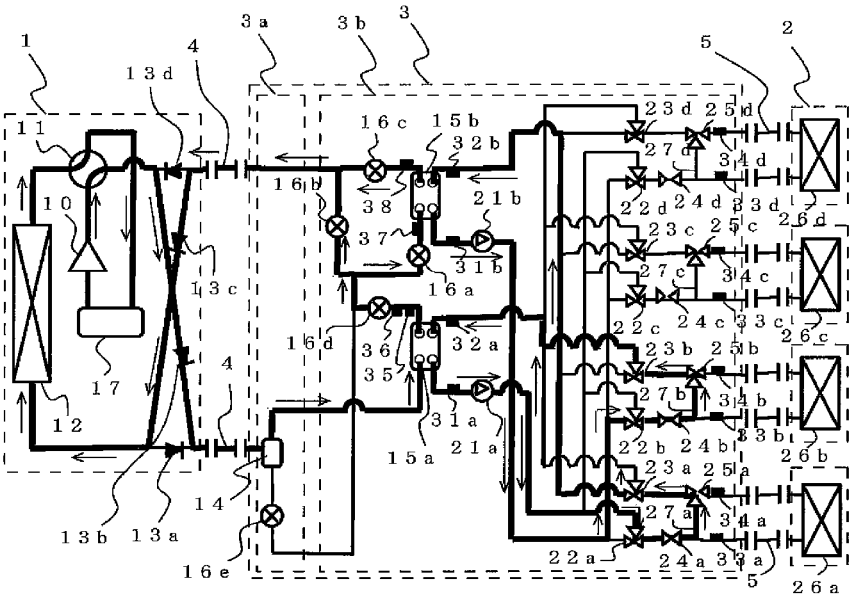
FIG. 8 is a first circuit diagram showing the refrigerant and the heat medium flow at the time of anti-freezing operation.

Operations of the refrigeration cycle then will be explained. When detecting the temperature equal to or lower than the set temperature in the flow path corresponding to the intermediate heat exchanger 15*a*, normal operation is allowable. However, when detecting the temperature equal to or lower than the set temperature in the flow path corresponding to the intermediate heat exchanger 15*b*, it is necessary to guide the high-temperature high-pressure refrigerant into the intermediate heat exchanger 15*b*. Therefore, as shown in FIG. 8, by making the expansion valves 16*d* and 16*a* full open and throttling the expansion valve 16*c* to expand the refrigerant, it is possible to flow a high-temperature high-pressure gas refrigerant, a two-phase refrigerant or a liquid refrigerant into the refrigerant flow path of the intermediate heat exchanger 15*b*. Thus, it is possible to prevent freezing by heating the heat medium that flows through the heat medium flow path of the intermediate heat exchanger 15*b* and circulating the heated heat medium.

When any of the third temperature sensors 33*a* to 33*d* or the fourth temperature sensors 34*a* to 34*d* detect the temperature equal to or lower than the set temperature, either the pump 21*a* or 21*b* is operated and the heat medium is circulated in the intermediate heat exchanger 15*a* or 15*b* corresponding thereto. Further, the compressor 10 is made to operate, the four-way valve 11 is switched to the heating side, a high-temperature high-pressure refrigerant is guided into the intermediate heat exchanger 15*a* or 15*b* where the heat medium circulates, the heat medium is heated to increase temperature, and the heated heat medium having a increased temperature is made to circulate in the use side heat exchangers 26*a* to 26*d* corresponding to the temperature sensor that detected the temperature equal to or lower than the set temperature by switching the flow path switching valves 22*a* to 22*d* and 23*a* to 23*d* to perform anti-freezing operation.

The intermediate heat exchanger is divided into a heating intermediate heat exchanger 15*a* and a cooling intermediate heat exchanger 15*b*. When either a first temperature sensor 31*b* or a second temperature sensor 32*b* detects a temperature equal to or lower than the set temperature, a high-temperature high-pressure refrigerant cannot directly be guided into the cooling intermediate heat exchanger 15*b*.

Figure 9:
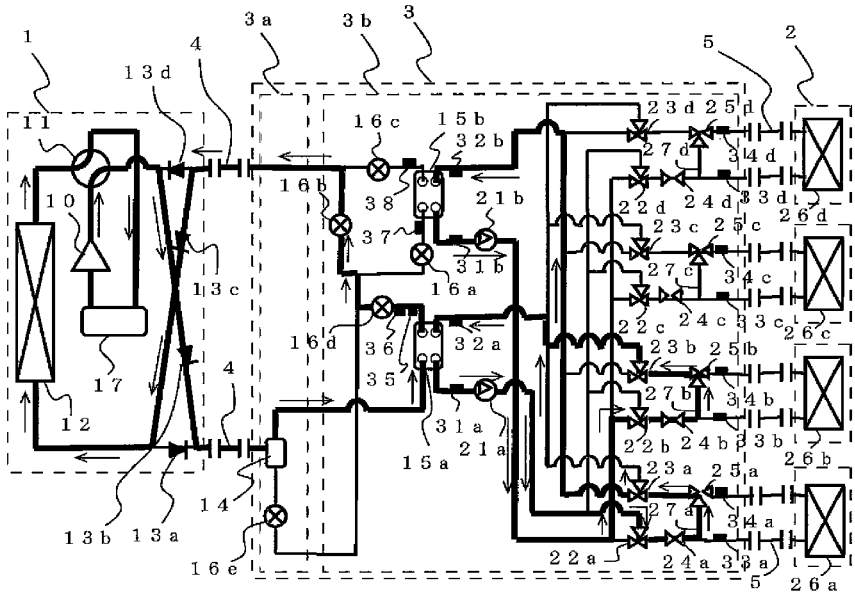
FIG. 9 is a second circuit diagram showing the refrigerant and the heat medium flow at the time of anti-freezing operation.

Then, as shown in FIG. 9, the refrigeration cycle is operated such that a high-temperature high-pressure refrigerant is made to circulate in the heating intermediate heat exchanger 15*a*. The flow path switching valves 22*a* to 22*d* corresponding to the use side heat exchanger (here, 26*a*) as a part of the use side heat exchangers 26*a* to 26*d* are switched so as to be connected with the intermediate heat exchanger 15*a*, and the flow path switching valves 23*a* to 23*d* are switched so as to be connected with the intermediate heat exchanger 15*b*. The flow path switching valves 22*a* to 22*d* corresponding to another use side heat exchanger (here, 26*b*) are switched so as to be connected with the intermediate heat exchanger 15*b*, and flow path switching valves 23*a* to 23*d* are switched so as to be connected with the intermediate heat exchanger 15*a*. Then, the pumps 21*a* and 21*b* are operated and the heat medium heated by the intermediate heat exchanger 15*a* is made to circulate in the cooling intermediate heat exchanger 15*b*. In FIG. 9, the flow path switching valve 22*a* is switched to the outlet side of the heating intermediate heat exchanger 15*a*, the flow path switching valve 23*a* to the inlet side of the cooling intermediate heat exchanger 15*b*, the flow path switching valve 22*b* to the outlet side of the cooling intermediate heat exchanger 15*b*, the flow path switching valve 23*b* to the inlet side of the heating intermediate heat exchanger 15*a*, and the heat medium is made to circulate between the intermediate heat exchangers 15*a* and 15*b*.

Figure 13:
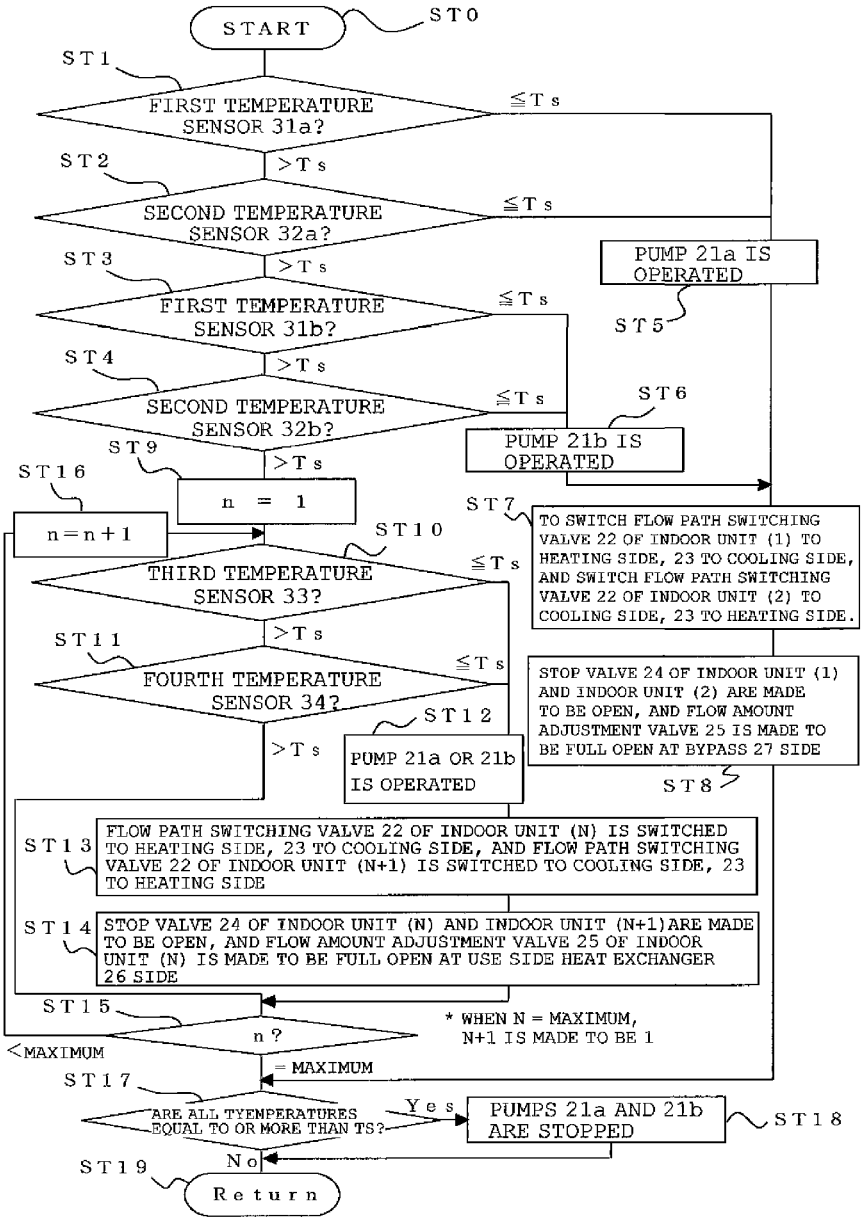
FIG. 13 is a first flow chart showing the operation of anti-freezing operation mode.
Figure 14:
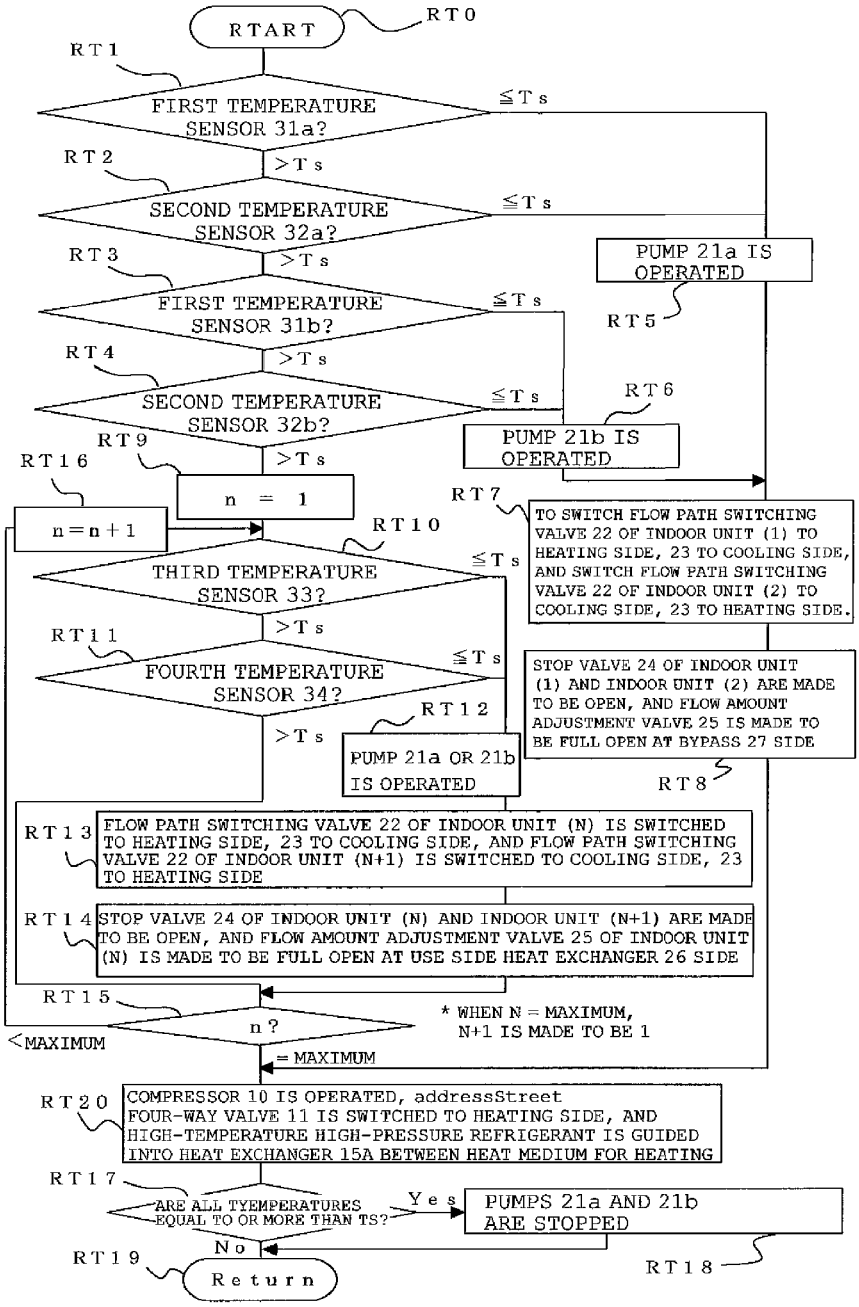
FIG. 14 is a second flow chart showing the operation of anti-freezing operation mode.

FIG. 14 is a flow chart illustrating an operation of the above. Since from RT0 to RT17 in FIG. 14 are the same as from ST0 to ST17 in FIG. 13 and regarding the circulation of the heat medium, it is the same as what is explained in the above, descriptions is omitted. In FIG. 14, the compressor 10 is made to operate, the four-way valve 11 is switched to the heating side, a step (RT20) is added to guide a high-temperature high-pressure refrigerant to the heating intermediate heat exchanger 15*a*. While heating the heating intermediate heat exchanger 15*a* by the refrigerant, the heat medium heated by the refrigerant is made to circulate. Then the temperature of the heat medium is increased and freezing can be prevented. When all detection temperatures of the temperature detection means become higher than the set temperature Ts (RT17), the pumps 21*a* and 21*b* and the compressor 10 are stopped. (RT18)

Figure 10:
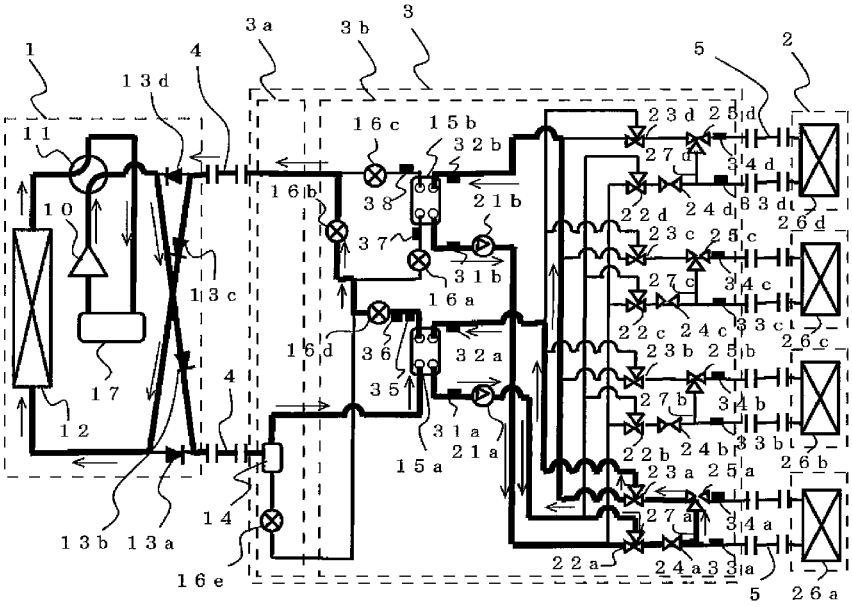
FIG. 10 is a third circuit diagram showing the refrigerant and the heat medium flow at the time of anti-freezing operation.

As shown in FIG. 10, as the flow path switching valves 22*a* to 22*d* and 23*a* to 23*d*, a valve is used having a structure allowing to set at an opening-degree in the midway between full open and full close such as a stepping motor type. The refrigeration cycle is operated so that a high-temperature high-pressure refrigerant is circulated in the heating intermediate heat exchanger 15*a*. The pumps 21*a* and 21*b* are operated. The heat medium flow path switching valves 22*a* and 22*d* corresponding to part of the use side heat exchangers 26*a* to 26*d* are set at a midway opening-degree that both of two paths, the heat medium flow path for heating and the heat medium flow path for cooling, are neither full open nor completely closed. The heat medium heated by the intermediate heat exchanger 15*a* and the heat medium passing through the cooling intermediate heat exchanger 15*b* are mixed. The heat medium flow path switching valves 23*a* to 23*d* are set at a midway opening-degree that the flow path is neither full open nor completely closed, as well. The heat medium mixed in the flow path switching valves 22*a* to 22*d* is adapted to be distributed into the intermediate heat exchanger 15*a* and the intermediate heat exchanger 15*b*. Thus, the heat medium flowing into the intermediate heat exchanger 15*b* gets to be a higher temperature than the heat medium prior to mixing by the heat amount of the heat medium heated by the intermediate heat exchanger 15*a*, therefore, freezing of the heat medium can be prevented in the intermediate heat exchanger 15*b*.

Figure 15:
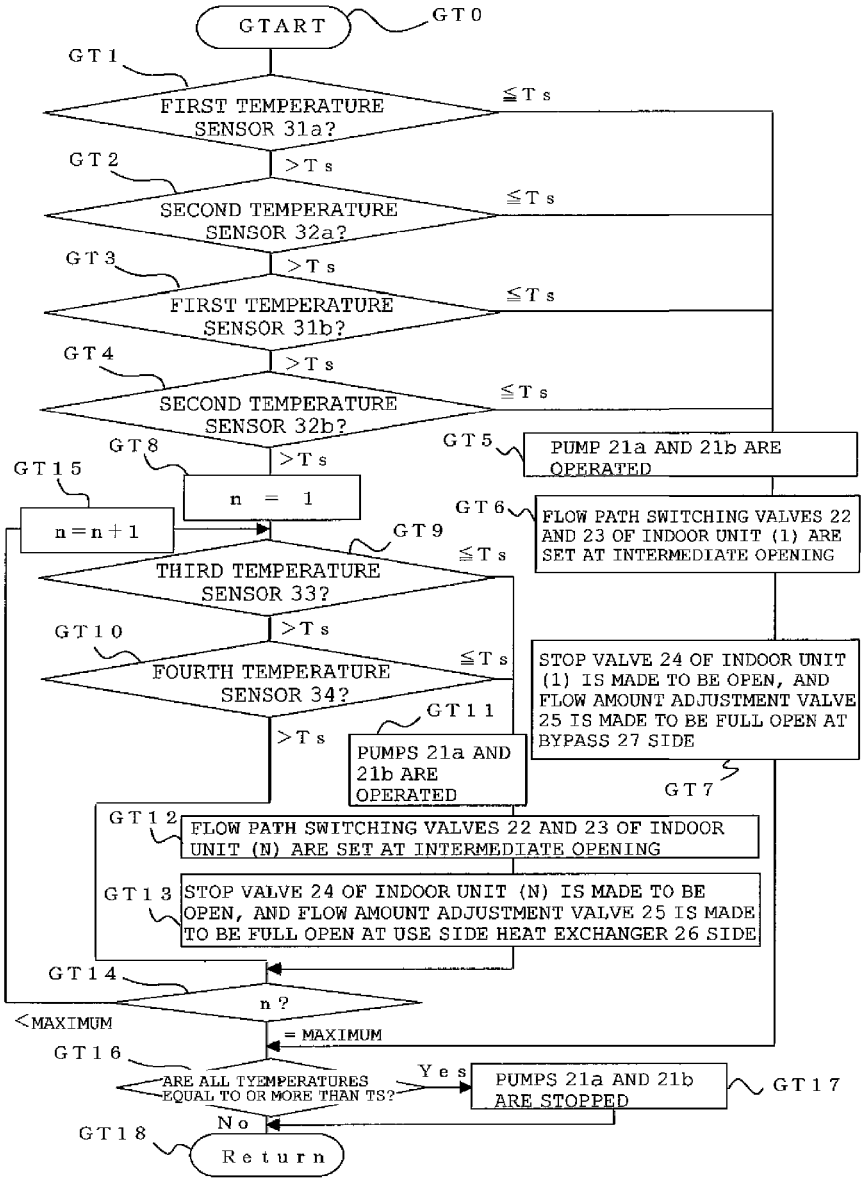
FIG. 15 is a third flow chart showing the operation of anti-freezing operation mode.

The control of the above-mentioned configuration is shown at a flow chart in FIG. 15. Here, as the heat medium flow path switching valves 22 and 23, those that can set at an intermediate opening-degree between full open and full close by a stepping motor or the like will be used.

After the processing starts (GT0), when the detection temperature of the first temperature sensor 31*a* or the second temperature sensor 32*a* corresponding to the intermediate heat exchanger 15*a* or the detection temperature of the first temperature sensor 31*b* or the second temperature sensor 32*b* corresponding to the intermediate heat exchanger 15*b* is detected to be equal to or lower than the set temperature Ts (GT1 to GT4), the controller 300 operates the pumps 21*a* and 21*b* (GT5). Then, the flow path switching valves 22 and 23 of a first indoor unit 1 are set at an intermediate opening (GT6), for example, and the stop valve 24 of the first indoor unit 1 is made to be open and the flow amount adjustment valve 25 is made to be full open at the bypass 27 side (GT7).

From "1" of the indoor unit to the maximum number of installed units, the detection temperatures of the third temperature sensor 33 and the fourth temperature sensor 34 corresponding to each unit are searched in order (ST9, ST15, ST16). When those temperature detection means detect the temperature equal to or lower than the set temperature Ts (ST9, ST10), the pumps 21*a* and 21*b* are made to operate (ST11). The flow path switching valves 22 and 23 of the indoor unit (n) that detected the temperature equal to or lower than the set temperature Ts is set at an intermediate opening-degree (GT12), the stop valve 24 of the indoor unit (n) is made to be open, and the flow amount adjustment valve 25 is made to be full open to the use side heat exchanger 26 side (GT13).

When the detection temperature of all the above-mentioned temperature sensors becomes higher than the set temperature Ts (ST16), the pumps 21*a* and 21*b* are made to stop (ST17) to complete the processing (ST18). Only either pump 21*a* or 21*b* may be operated in GT5 and GT12.

In the method of the flow chart of FIG. 15, since the heat medium heated at the heating operation is made to be circulated into the flow path that prevents freezing, anti-freezing effect can be expected more than the method of the flow chart of FIG. 13. However, when some time has elapsed after the stop of the heating operation, anti-freezing will be less effective.

In order to further steadily perform anti-freezing in this case as well, when the temperature equal to or lower than the set temperature is detected by either the first temperature sensor 31*a* or 31*b*, or the second temperature sensor 32*a* or 32*b*, with the pump 21*a* or 21*b* being in operation corresponding to the intermediate heat exchanger 15*a* or 15*b* corresponding to the temperature sensor that detected the temperature equal to or lower than the set temperature, the compressor 10 is made to operate, the four-way valve 11 is switched to the heating side, the high-temperature high-pressure refrigerant is introduced into the intermediate heat exchanger 15*a* or 15*b* corresponding to the temperature sensor that detected the temperature equal to or lower than the set temperature, and the heat medium is heated to rise the temperature, so as to perform anti-freezing.

Figure 16:
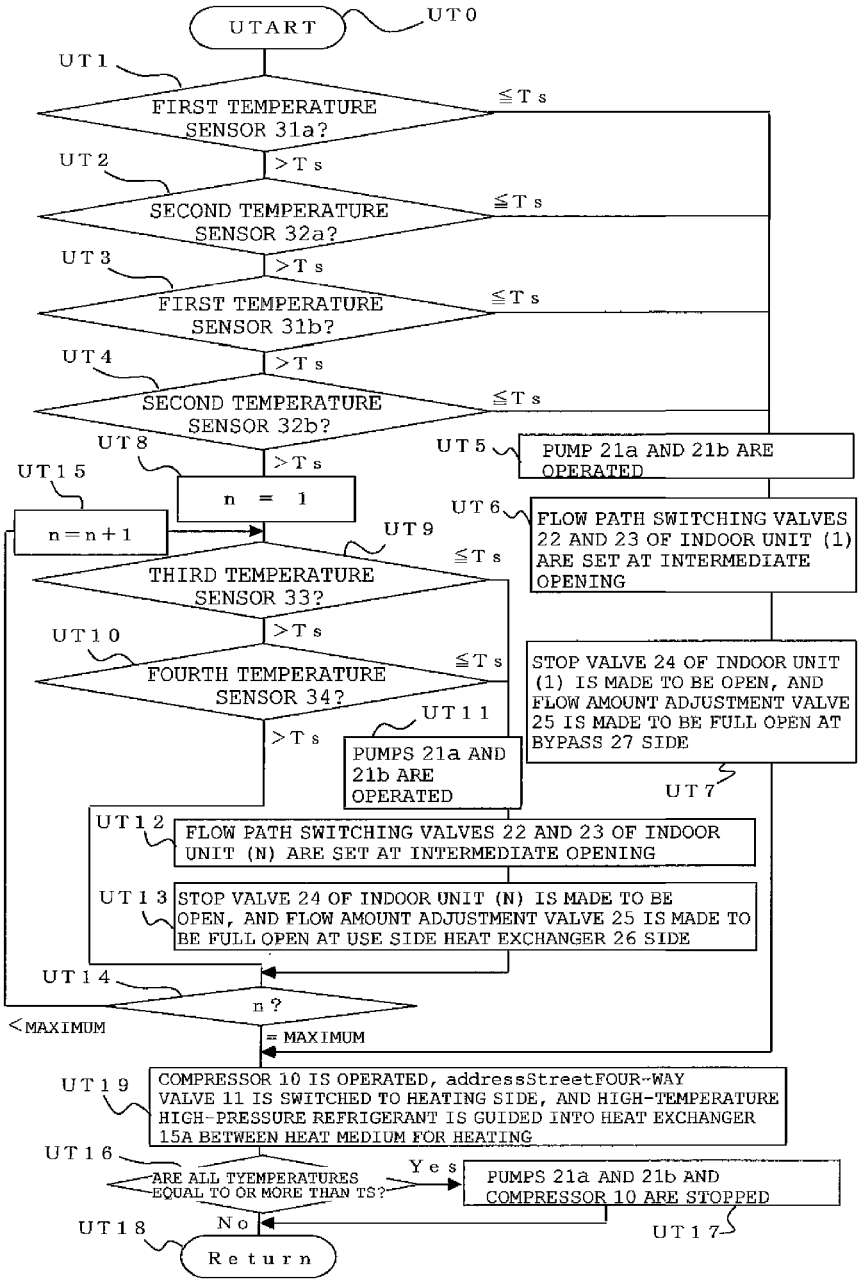
FIG. 16 is a fourth flow chart showing the operation of anti-freezing operation mode.

FIG. 16 is a flowchart illustrating this operation. Since from UT0 to UT16 in FIG. 16 are the same as from GT0 to GT16 in FIG. 15 and regarding the circulation of the heat medium it is the same as what is explained in the above, descriptions will be omitted. In FIG. 16, the compressor 10 is operated, the four-way valve 11 is switched to the heating side, a step (UT19) is added to guide a high-temperature high-pressure refrigerant to the heating intermediate heat exchanger 15*a*. While heating the heating intermediate heat exchanger 15*a* by the refrigerant, by circulating the heat medium, the temperature of the heat medium passing through the intermediate heat exchangers 15*a* and 15*b* is increased and freezing can be prevented. When the detection temperatures of all the temperature sensors become higher than the set temperature Ts (UT16), the pumps 21*a* and 21*b* and the compressor 10 are stopped. (UT17)

In order to prevent the heat medium from freezing, there is a method to make the heat medium circulate by operating the pump like the flow chart of FIGS. 13 and 15. However, when the temperature of the heat medium further decreases or does not increase after a certain time elapses even with the method, it is desirable to judge that anti-freezing is difficult only by circulating the refrigerant and then operate the compressor to perform control like the flow chart of FIG. 14 or 16.

Figure 11:
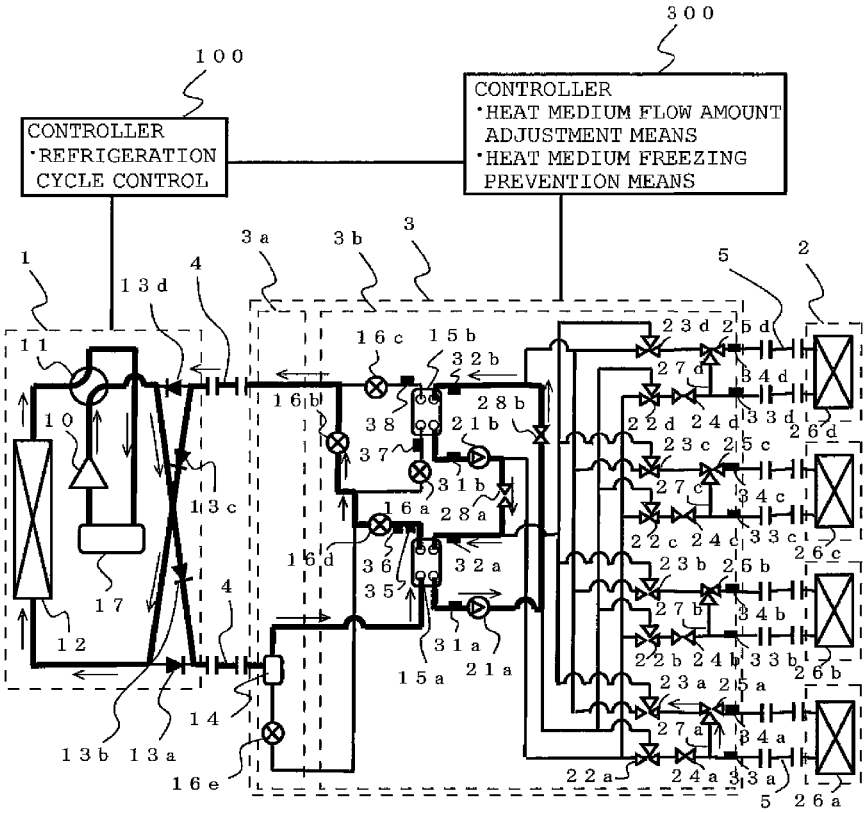
FIG. 11 is a fourth circuit diagram showing the refrigerant and the heat medium flow at the time of anti-freezing operation.

In order to prevent the heat medium from freezing, a flow path configuration of the heat medium as shown in FIG. 11 is effective. In FIG. 11, the outlet side of the pump 21*b* of the outlet side of the cooling intermediate heat exchanger 15*b* and the inlet side of the heating intermediate heat exchanger 15*a* are bypass-connected via a bypass stop valve 28*a*, and the outlet side of the pump 21*a* of the outlet side of the heating intermediate heat exchanger 15*a* and the inlet side of the cooling intermediate heat exchanger 15*b* are bypass-connected via a bypass stop valve 28*b*. Then, when the pumps 21*a* and 21*b* are made to operate, a flow path is formed in which the heat medium flows through the cooling intermediate heat exchanger 15*b*, the pump 21*b*, the bypass stop valve 28*a*, the heating intermediate heat exchanger 15*a*, the pump 21*a*, the bypass stop valve 28*b*, and the cooling intermediate heat exchanger 15*b* in order. Thereby, since the heated heat medium at the heating intermediate heat exchanger 15*a* side flows into the cooling intermediate heat exchanger 15*b* side, the heat medium in the flow path of the cooling intermediate heat exchanger 15*b* is heated and enabled to be anti-freezing. In case that heat amount is still not enough, the compressor 10 is operated and the heating intermediate heat exchanger 15*a* is heated.

In the configuration of FIG. 11, since no heat medium flows through the flow path switching valves 22 (22*a* to 22*d*) and 23 (23*a* to 23*d*) and the flow amount adjustment valve 25 (25*a* to 25*d*), mixing of the heat medium can be made small in the heating flow path and the cooling flow path and heat loss of the heat medium can be made small when performing heating or cooling in the next operation. Further, since no pressure loss is created caused by each valve 22, 23, and 25 and piping, pumping power can be made small during anti-freezing operation advantageously.

Figure 17:
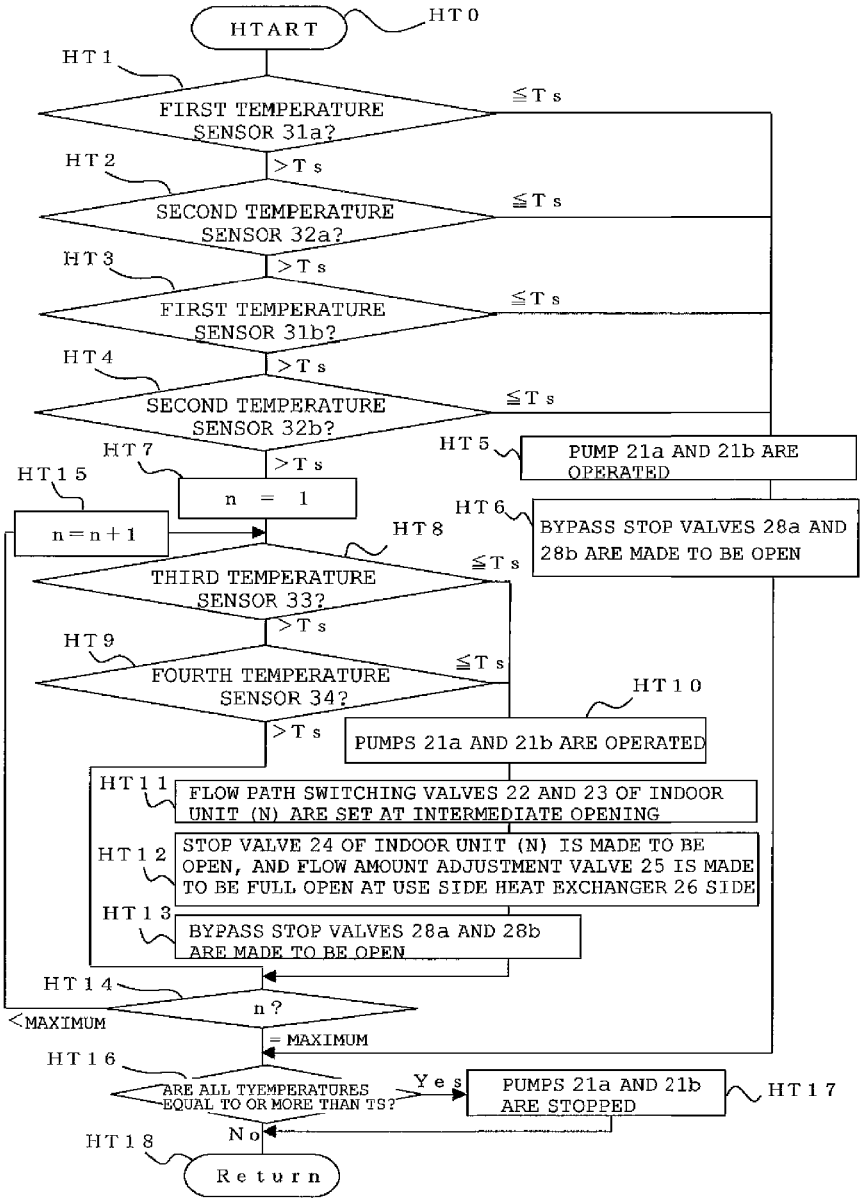
FIG. 17 is a fifth flow chart showing the operation of anti-freezing operation mode.

Descriptions will be given to the operation of the above by the flow chart of FIG. 17. Here, as the flow path switching valves 22 and 23, anything that can set at an intermediate opening-degree between full open and full close by a stepping motor or the like will be used.

After the processing starts (HTO), the controller 300 judges whether the detection temperatures of the first temperature sensor 31*a* or the second temperature sensor 32*a* related to the intermediate heat exchanger 15*a* or the detection temperature of the first temperature sensor 31*b* or the second temperature sensor 32*b* related to the intermediate heat exchanger 15*b* are equal to or lower than the set temperature Ts or not (HT1 to HT4). When the temperature in the above-mentioned step is detected to be equal to or lower than the set temperature Ts, the pumps 21*a* and 21*b* are operated (HT5), the bypass stop valves 28*a* and 28*b* are made to be open (HT6), and the heat medium is made to circulate via the bypass between the intermediate heat exchangers 15*a* and 15*b*. The circulation circuit thereof is shown by a thick line in the heat medium circuit of FIG. 11.

Further, in searching from "1" of the indoor unit to the maximum number of installed units in order (HT7, HT14, HT15), when the detection temperature of the third temperature sensor 33 is detected to be equal to or lower than the set temperature Ts (HT8) or the fourth temperature sensor 34 detects the temperature equal to or lower than the set temperature Ts (HT9), the pump 21*a* and the pump 21*b* are made to operate (HT10). Then, the flow path switching valves 22 and 23 of the n-th indoor unit (n) whose temperature is detected to be equal to or lower than the set temperature are set at an intermediate opening (HT11). The stop valve 24 of the indoor unit (n) is made to be open and the flow amount adjustment valve 25 is made to be full open to the use side heat exchanger 26 side (HT12). The bypass stop valves 28*a* and 28*b* are made to be close (HT13). A flow path is configured to make the heat medium to circulate to the use side heat exchangers 26*a* to 26*d* side.

When the detection temperatures of all the above-mentioned temperature sensors become higher than the set temperature Ts (HT16), the pumps 21*a* and 21*b* are stopped (HT17), and processing is terminated (HT18). In HT5 and HT10, either the pump 21*a* or 21*b* may be operated.

The above mentioned set temperature Ts is set at a temperature a little higher than a freezing temperature. For example, if the heat medium is water, Ts may be set at 3 degrees C., a little higher than the freezing temperature 0 degree C.

In the anti-freezing operation, a circulation flow path of the heat medium has to be secured before or at the same time as the pump 21*a* or 21*b* is operated. Therefore, in order to form a heat medium circulation circuit, after any or all of the stop valves 24*a* to 24*d* are made to be open state, and the flow amount adjustment valves 25*a* to 25*d* are controlled to the direction in which the flow path is secured, the pump 21*a* or 21*b* is made to operate so as to circulate the heat medium.

Figure 12:
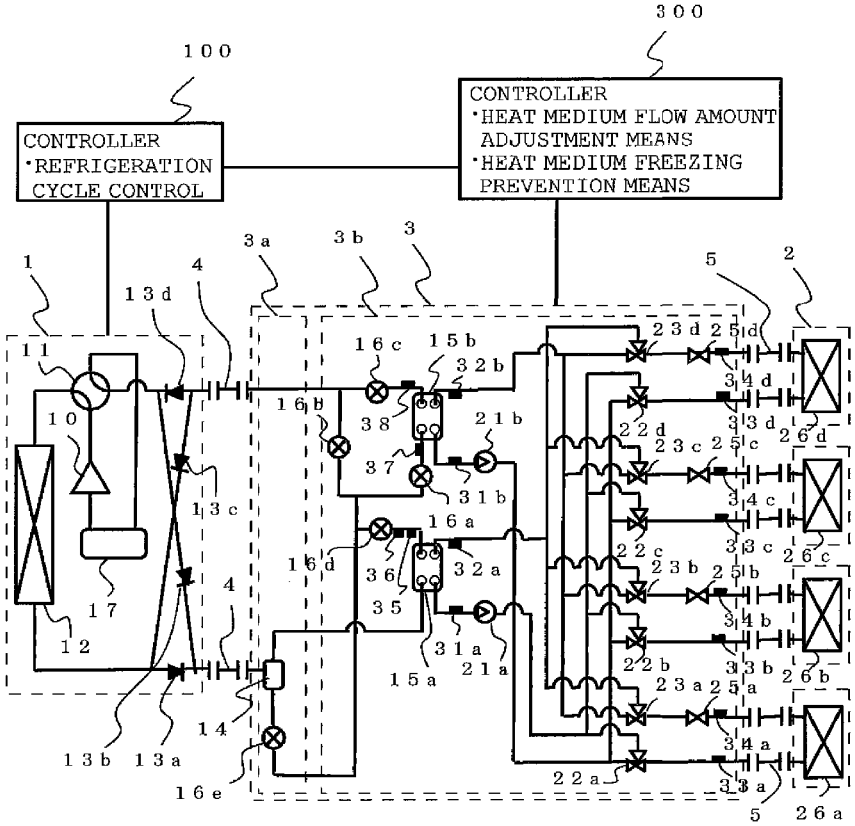
FIG. 12 is a fifth circuit diagram showing the refrigerant and the heat medium flow at the time of anti-freezing operation.

As shown in FIG. 12, as the flow amount adjustment valves 25*a* to 25*d*, a two-way flow amount adjustment valve may be used. Then, the stop valves 24*a* to 24*d* need not to be provided. After controlling the opening-degree of the flow amount adjustment valves 25*a* to 25*d* to secure the circulation flow path of the heat medium, the pumps 21*a* to 21*d* are operated.

In the present embodiment, temperature sensors are installed at the inlet and outlet of the intermediate heat exchangers 15*a* and 15*b*. However, in order to control the pumps 21*a* and 21*b*, only either the inlet temperature or the outlet temperature may be detected, therefore, the temperature sensor may be installed either at the inlet or at the outlet.

The refrigerant may be a single refrigerant such as R-22 and R-134a, a pseudo-azeotropic mixture refrigerant such as R-410A and R-404A, an azeotropic mixture refrigerant such as R-407C, a refrigerant and its mixture that is regarded to have a smaller global warming potential such as $CF_3CF{=}CH_2$ including a double bond in the chemical formula, or a natural refrigerant such as $CO_2$ and propane.

Although the refrigerant circuit is configured to contain an accumulator, a circuit having no accumulator is possible. Descriptions are given to the case where there are the check valves 13*a* to 13*d*, however, they are not an indispensable component, the present invention can be configured by a circuit without them, and then the same operation and the same working effect can be achieved.

A fan should be attached to the heat source side heat exchanger 12 and the use side heat exchangers 26*a* to 26*d* and it is preferable to accelerate condensation or evaporation by blowing. It is not limited thereto, but as for the use side heat exchangers 26*a* to 26*d*, a panel heater utilizing radiation may be used. As for the heat source side heat exchanger 12, a water-cooled type may be used that transfers heat by water and anti-freezing liquid. Any type can be used having a structure that can release or absorb heat.

Descriptions are given to the case where there are four use side heat exchangers 26*a* to 26*d*, however, there is no limit for the number of units of the use side heat exchanger.

Descriptions are given to the case where the flow path switching valves 22*a* to 22*d* and 23*a* to 23*d*, the stop valves 24*a* to 24*d*, and the flow amount adjustment valves 25*a* to 25*d* are connected with the use side heat exchangers 26*a* to 26*d* on a one-by-one basis, however, it is not limited thereto. Each use side heat exchanger may be connected with a plurality of them. Then, the flow path switching valve, the stop valve, and the flow amount adjustment valve connected to the same use side heat exchanger may be operated in the same way.

In the above-mentioned embodiment, descriptions are given to the case where there are the intermediate heat exchanger 15*a* for heating and the intermediate heat exchanger 15*b* for cooling, however, it is not limited thereto. In the case of only heating or cooling, one intermediate heat exchanger is enough. In that case, at the time of the anti-freezing operation, no heat medium needs to be passed through another intermediate heat exchanger, therefore, the flow path is more simplified. One set or more of the intermediate heat exchanger 15*a* for heating and the intermediate heat exchanger 15*b* for cooling may be provided.

In place of the three-way flow path type flow amount adjustment valves 25*a* to 25*d* of FIG. 3, a flow amount adjustment valve of a two-way flow path adjustment valve may be employed that can sequentially change the opening area by a stepping motor or the like as shown in FIG. 12. The control in this case is similar to the case of the three-way flow path adjustment valve. The opening of the two-way flow path adjustment valves 25*a* to 25*d* is adjusted to control the flow amount to be flowed into the use side heat exchangers 26*a* to 26*d* so that the difference in temperature between the inlet and outlet of the use side heat exchangers 26*a* to 26*d* becomes a predetermined target value, for example, 5 degrees C. Then, the rotation speed of the pumps 21*a* and 21*b* may be controlled so that the inlet side or the outlet side temperature of the intermediate heat exchangers 15*a* and 15*b* becomes a predetermined target value. When using the two-way flow path adjustment valve as the flow amount adjustment valves 25*a* to 25*d*, since it can be used for opening and closing the flow path, no stop valves 24*a* to 24*d* are required and low-cost system construction is enabled advantageously.

Here, descriptions are given to the case where the flow amount adjustment valves 25*a* to 25*d*, the third temperature sensors 33*a* to 33*d*, the fourth temperature sensors 34*a* to 34*d* are installed inside of the relay unit 3, however, it is not limited thereto. If they are installed near the use side heat exchangers 26*a* to 26*d*, that is, inside of or near the indoor unit 2, there is no functional problem and the same operation and the same working effect can be achieved. When employing the two-way flow path adjustment valve as the flow amount adjustment valves 25*a* to 25*d*, the third temperature sensors 33*a* to 33*d* and the fourth temperature sensors 34*a* to 34*d* may be installed inside of or near the relay unit 3 and the flow amount adjustment valves 25*a* to 25*d* may be installed inside of or near the indoor unit 2.

As mentioned above, when the temperature of the heat medium is detected to be equal to or lower than the set temperature, the air-conditioning apparatus according to the present invention prevents freezing of the heat medium in pipelines to safely and steadily achieve energy saving by performing anti-freezing operation such as operating the pump to circulate the heat medium.

The invention claimed is:

1. An air-conditioning apparatus, comprising:

an intermediate heat exchanger that exchanges heat between a refrigerant and a heat medium including water or brine, said heat medium differs from said refrigerant;

a refrigeration cycle that connects a compressor, a four-way valve, a heat source side heat exchanger, at least one expansion valve, and a refrigerant side flow path of said intermediate heat exchanger via piping through which said refrigerant flows;

a heat medium circulation circuit that connects a heat medium side flow path of said intermediate heat exchanger, a pump, and a use side heat exchanger via piping through which said heat medium flows;

a temperature sensor to detect a temperature of said heat medium, installed in said heat medium circulation circuit;

a first controller to control said compressor and said four-way valve; and a second controller to control said pump, wherein said heat source side heat exchanger, said intermediate heat exchanger, and said use side heat exchanger are provided in separate bodies respectively, wherein if said compressor and said pump are stopped and when a detection temperature of said temperature sensor becomes equal to or lower than a set temperature, said air-conditioning apparatus starts to perform an anti-freezing operation mode, and wherein as said intermediate heat exchanger, an intermediate heat exchanger that heats said heat medium and an intermediate heat exchanger that cools said heat medium are provided, flow path switching valves that switch the flow path to each intermediate heat exchanger at the inlet side and outlet side of a heat medium side flow path of said use side heat exchanger are provided, and in said anti-freezing operation mode, said second controller is configured to operate said pump to cause said heat medium to circulate through said heat medium circulation circuit, thereafter said first controller is configured to operate said compressor and switch said four-way valve to a heating side to cause a high-temperature high-pressure refrigerant discharged from said compressor to flow into said intermediate heat exchanger, and thereby heat said heat medium circulating through said heat medium circulation circuit.

2. The air-conditioning apparatus of claim 1, wherein in the anti-freezing operation mode of said heat medium, said temperature sensors are installed in an inlet side flow path or an outlet side flow path of said pumps, said second controller is configured to operate pumps corresponding to said intermediate heat exchanger corresponding to said temperature sensor that detected a temperature equal to or lower than said set temperature, and said heat medium is made to circulate through said heat medium circulation circuit.

3. The air-conditioning apparatus of claim 1, wherein a bypass is connected between a heat medium inlet side flow path and a heat medium outlet side flow path of said use side heat exchanger to adjust said heat medium flowing through said use side heat exchanger, and in the anti-freezing operation mode, said heat medium is made to circulate through said bypass.

4. The air-conditioning apparatus of claim 1, wherein a high-temperature high-pressure refrigerant is made to flow into said intermediate heat exchanger corresponding to said temperature sensor that detected a temperature of said heat medium equal to or lower than said set temperature.

5. The air-conditioning apparatus of claim 1, wherein in the anti-freezing operation mode of said heat medium, said compressor is operated and part of a plurality of said intermediate heat exchangers is operated for heating the heat medium, said flow path switching valve is switched and the heat medium is circulated from the intermediate heat exchanger for heating the heat medium to said intermediate heat exchanger corresponding to said temperature sensor that detected a temperature of said heat medium equal to or lower than said set temperature.

6. The air-conditioning apparatus of claim 1, wherein a flow amount adjustment valve is installed at a heat medium inlet side flow path or a heat medium outlet side flow path of said use side heat exchanger, and before or as soon as said pump is operated, said flow amount adjustment valve is controlled in a direction in which a circulation flow path of said heat medium is established.

* * * * *